US010995998B2

(12) United States Patent
Penny et al.

(10) Patent No.: US 10,995,998 B2
(45) Date of Patent: May 4, 2021

(54) FINNED COAXIAL COOLER

(71) Applicant: Senior UK Limited, Gwent (GB)

(72) Inventors: Charles Penny, Ross-on-Wye (GB); Timothy M. Walsh, Oswego, IL (US); Ryan Collins, Glen Ellyn, IL (US); Thomas J. Carney, Batavia, IL (US); Mark Davey, North Aurora, IL (US); Edward S. Buttermore, South Elgin, IL (US); Adrian Ware, Gwent (GB); Ragu Subramanyam, Blackwood (GB)

(73) Assignee: Senior UK Limited, Crumlin (GB)

( * ) Notice: Subject to any disclaimer, the term of this patent is extended or adjusted under 35 U.S.C. 154(b) by 321 days.

(21) Appl. No.: 15/419,758

(22) Filed: Jan. 30, 2017

(65) Prior Publication Data

US 2017/0138670 A1 May 18, 2017

Related U.S. Application Data

(63) Continuation-in-part of application No. 15/211,609, filed on Jul. 15, 2016.

(30) Foreign Application Priority Data

Jul. 30, 2015 (GB) ..... 1513415
Aug. 27, 2015 (EP) ..... 15002537

(51) Int. Cl.
*F28D 7/10* (2006.01)
*F28F 1/08* (2006.01)
(Continued)

(52) U.S. Cl.
CPC ..... *F28D 7/106* (2013.01); *F02M 26/32* (2016.02); *F28D 7/14* (2013.01); *F28D 21/0003* (2013.01);
(Continued)

(58) Field of Classification Search
CPC ..... F28D 7/106; F28D 21/0003; F28D 7/14; F28D 2021/0026; F02M 26/32;
(Continued)

(56) References Cited

U.S. PATENT DOCUMENTS 2,212,932 A * 8/1940 Fairlie ..... B01J 19/30 261/94
2,401,974 A * 6/1946 Siebels ..... F16L 59/07 285/55
(Continued)

FOREIGN PATENT DOCUMENTS

AU 1621370 12/1971
CN 2869738 2/2007
(Continued)

OTHER PUBLICATIONS

U.S. Patent and Trademark Office, Final Office Action issued in U.S. Appl. No. 15/211,609, dated Jan. 3, 2020, 17 pgs.
(Continued)

*Primary Examiner* — Ljiljana V. Ciric
(74) *Attorney, Agent, or Firm* — Greenberg Traurig, LLP

(57) ABSTRACT

An improved heat exchanger suitable for use as a pre-cooler in an internal combustion engine exhaust gas recirculation system includes an inner heat exchange tube for exchanging heat between a gas and a coolant. A tubular outer body surrounds at least part of the inner heat exchange tube. Coolant flows through a cavity formed between the outer surface of the inner heat exchange tube and the inner surface of the tubular outer body, cooling the gas flowing through the inner heat exchange tube. The inner heat exchange tube surrounds a rolled, cylindrically-shaped corrugated sheet of material forming a plurality of fins. At least one of the fins is in contact with an inner surface of the inner heat exchange tube. The tubular outer body surrounds two or more inner
(Continued)

heat exchange tubes, each inner heat exchange tube surrounding a respective plurality of fins.

11 Claims, 23 Drawing Sheets

(51) Int. Cl.

| | |
|---|---|
| ***F28F 1/42*** | (2006.01) |
| ***F28F 13/12*** | (2006.01) |
| ***F28D 7/14*** | (2006.01) |
| ***F28D 21/00*** | (2006.01) |
| ***F02M 26/32*** | (2016.01) |
| ***F28F 1/06*** | (2006.01) |

(52) U.S. Cl.
CPC ..... *F28F 1/06* (2013.01); *F28F 1/08* (2013.01); *F28F 1/426* (2013.01); *F28F 13/12* (2013.01); *F28D 2021/0026* (2013.01); *F28F 2265/26* (2013.01)

(58) Field of Classification Search
CPC ..... F28F 1/06; F28F 1/08; F28F 13/12; F28F 1/426; F28F 2265/26
See application file for complete search history.

(56) References Cited

U.S. PATENT DOCUMENTS 2,529,516 A * 11/1950 Scheibel ..... F28F 1/40 165/81
2,611,585 A * 9/1952 Boling ..... F28D 7/0016 165/164
2,692,763 A * 10/1954 Holm ..... F28D 7/106 165/154
2,693,026 A * 11/1954 Simpelaar ..... B21C 37/151 29/890.036
2,703,921 A * 3/1955 Brown, Jr. ..... F28D 7/103 29/890.036
2,726,681 A * 12/1955 Gaddis ..... B21C 37/225 138/38
2,756,032 A * 7/1956 Dowell ..... F28D 21/0008 165/121
2,778,610 A * 1/1957 Bruegger ..... B01J 15/005 126/109
2,887,456 A * 5/1959 Preece ..... B01J 35/02 502/347
2,960,114 A * 11/1960 Hinde ..... F28F 13/06 138/38
3,002,729 A * 10/1961 Welsh ..... F28F 1/20 165/183
3,158,122 A * 11/1964 De Give ..... B21D 53/08 29/890.036
3,197,975 A * 8/1965 Boling ..... F24F 5/001 62/498
3,200,848 A * 8/1965 Takagi ..... F28F 1/105 138/38
3,474,513 A * 10/1969 Allingham ..... F28D 7/106 29/890.036
3,636,607 A * 1/1972 DeMarco ..... F28F 1/105 29/890.036
3,857,680 A * 12/1974 Porta ..... B01J 12/007 422/200
3,871,407 A * 3/1975 Bykov ..... F28F 13/185 138/38
3,887,004 A * 6/1975 Beck ..... F28F 1/42 165/179
4,031,602 A * 6/1977 Cunningham ..... B21C 37/151 29/890.036
4,059,882 A * 11/1977 Wunder ..... B21D 53/08 29/890.036
4,096,616 A * 6/1978 Coffinberry ..... B21D 53/06 29/890.036
4,096,910 A * 6/1978 Coffinberry ..... F28D 7/106 165/81
4,190,105 A * 2/1980 Dankowski ..... F28F 13/06 165/179
4,284,133 A * 8/1981 Gianni ..... F28D 7/106 165/133
4,296,539 A * 10/1981 Asami ..... F16L 9/19 165/115
4,306,619 A * 12/1981 Trojani ..... F28F 1/42 165/179
4,373,578 A * 2/1983 Saperstein ..... F28F 9/0234 165/141
4,412,126 A * 10/1983 Brockway ..... H05B 3/44 165/183
4,419,802 A * 12/1983 Riese ..... B21C 37/151 165/179
4,432,485 A * 2/1984 Smith ..... B23K 37/053 138/148
4,633,939 A * 1/1987 Granetzke ..... F28D 7/106 165/154
4,779,284 A * 10/1988 Nissen ..... H01S 3/036 372/107
4,821,797 A * 4/1989 Allgauer ..... F16N 39/02 165/141
4,928,485 A * 5/1990 Whittenberger ..... F01N 13/009 60/299
5,062,474 A * 11/1991 Joshi ..... F28D 1/0333 165/109.1
5,070,694 A * 12/1991 Whittenberger ..... F01N 3/2814 60/300
5,107,922 A * 4/1992 So ..... F28F 1/105 165/109.1
5,215,144 A * 6/1993 May ..... F28D 21/0008 165/154
5,251,693 A * 10/1993 Zifferer ..... F28D 7/0041 165/160
5,558,069 A * 9/1996 Stay ..... F28D 7/106 123/541
5,575,067 A * 11/1996 Custer ..... B28B 1/002 29/890.036
5,765,596 A * 6/1998 LaHaye ..... F16L 9/18 138/110
D427,669 S * 7/2000 Ruuska ..... D23/266
6,095,236 A * 8/2000 Kuhler ..... F28F 1/105 165/80.1
6,405,974 B1 * 6/2002 Herrington ..... B29C 48/21 242/609.4
6,434,972 B1 * 8/2002 Geiger ..... B60H 1/3227 165/156
6,439,298 B1 * 8/2002 Li ..... F28D 15/0233 165/104.21
6,446,336 B1 * 9/2002 Unger ..... F25B 9/14 29/890.046
6,488,079 B2 * 12/2002 Zifferer ..... F28F 1/06 165/133
6,571,862 B1 * 6/2003 Wang ..... F28F 3/025 165/80.3
7,191,824 B2 3/2007 Wu et al.
7,225,859 B2 * 6/2007 Mochizuki ..... F02G 1/055 165/10
7,682,580 B2 * 3/2010 Whittenberger ..... C01B 3/38 422/222
8,171,985 B2 * 5/2012 Valensa ..... F28D 7/0066 165/154
8,261,816 B2 9/2012 Ambros et al.
8,474,515 B2 * 7/2013 Burgers ..... F28D 9/0018 165/164
8,516,699 B2 8/2013 Grippe et al.
8,550,147 B2 * 10/2013 Lansinger ..... B60S 1/54 165/41
8,992,850 B2 * 3/2015 Vanderwees ..... B01J 8/025 422/211
9,149,847 B2 * 10/2015 Holden ..... B21C 37/158
9,472,489 B2 10/2016 Nakamura et al.
9,664,451 B2 5/2017 Rockenfeller et al.
9,770,794 B2 * 9/2017 Singh ..... F28F 1/16

(56) References Cited

U.S. PATENT DOCUMENTS

| | | | | |
|---|---|---|---|---|
| 9,951,997 | B2 * | 4/2018 | Maurer | F28D 3/02 |
| 10,119,765 | B2 * | 11/2018 | Shao | F28D 9/0012 |
| 10,514,210 | B2 * | 12/2019 | Robb | F28F 19/06 |
| 2005/0109493 | A1 * | 5/2005 | Wu | F28D 7/103 165/157 |
| 2006/0048921 | A1 * | 3/2006 | Usui | F28F 3/027 165/109.1 |
| 2007/0295825 | A1 * | 12/2007 | McNaughton | B60S 1/487 237/12.3 B |
| 2012/0222845 | A1 | 9/2012 | Kinder et al. | |
| 2013/0089413 | A1 | 4/2013 | Fujimoto et al. | |
| 2014/0110095 | A1 * | 4/2014 | Chang | F28F 1/40 165/181 |
| 2014/0262174 | A1 * | 9/2014 | Wunning | F28F 1/006 165/158 |
| 2017/0234625 | A1 * | 8/2017 | Inagaki | F28F 1/08 165/104.26 |
| 2019/0353427 | A1 | 11/2019 | Johnson | |

FOREIGN PATENT DOCUMENTS

| | | | |
|---|---|---|---|
| CN | 103742298 | | 4/2014 |
| CN | 106197120 | A | 12/2016 |
| DE | 10349877 | A1 | 6/2005 |
| EP | 1096131 | A1 | 5/2001 |
| EP | 1388720 | A2 | 8/2003 |
| EP | 1388720 | A2 | 2/2004 |
| JP | H10170172 | A | 6/1998 |
| JP | H11108578 | | 4/1999 |
| JP | 2000079431 | A | 3/2000 |
| JP | 2000111277 | A | 4/2000 |
| JP | 2001227413 | | 8/2001 |
| JP | 2002054511 | | 2/2002 |
| JP | 2010078233 | A | 4/2010 |

OTHER PUBLICATIONS

Intellectual Property Office, Office Action issued in Application No. GB1701501.7, dated Jun. 28, 2019, 5 pgs.

Intellectual Property Office, Office Action issued in Application No. GB1903719.1, dated Jun. 28, 2019, 8 pgs.

European Search Report issued on EP15002537.7, completed Jan. 9, 2017, 2 pages.

European Search Report for Application No. EP 17000163.0, dated Feb. 9 2018.

* cited by examiner

FINNED COAXIAL COOLER

RELATED APPLICATION INFORMATION

This application is a continuation-in-part of U.S. patent application Ser. No. 15/211,609, filed Jul. 15, 2016, which claims priority to and the benefit of United Kingdom Application No. 1513415.8, filed on Jul. 30, 2015, European Application No. 15002537.7, filed on Aug. 27, 2015, the entire disclosures of each is incorporated herein by reference.

FIELD OF THE INVENTION

The present invention relates to heat exchangers.

BACKGROUND OF THE INVENTION

Modern internal combustion engines often use externally flowed and cooled exhaust gas recirculation (EGR) to aid emissions control and reduce fuel consumption. Modern gasoline and diesel engines can have high gas inlet temperatures into an exhaust gas recirculation system. These high gas temperatures can cause damage to EGR components, for example the EGR valve or the main cooler.

It can be of significant advantage to reduce the exhaust gas recirculation gas temperature prior to contact with these potentially vulnerable components. A coaxial cooler is a component which can fulfill this function.

A coaxial cooler which is known in the art comprises a heat transfer tube positioned inside an outer tube. The heat transfer tube has a formed or corrugated surface which encourages heat exchange and gives some flexibility to the component.

Three major drawbacks of this type of prior art design are:

- A relatively low heat exchange per unit length;
- A relatively high gas pressure loss caused by the turbulence induced by the corrugation; and
- A relatively poor flow of coolant into the roots of the outside of the heat exchange tube.

A pre cooler located upstream in the gas flow to a valve or main cooler in an EGR system needs to be compact and of the shortest possible length since space is at a premium in modern vehicle engine compartments.

On EGR systems in particular, a low gas pressure drop in the return gas path between exhaust and engine air intake is critical for engine function. As an ongoing objective, engineers are always looking to reduce pressure losses in EGR systems, as this allows a greater flow for the same differential pressure.

Further, boiling of coolant can cause damage to components, coolers, pre coolers or even damage to the engine itself.

A problem with prior art co-axial heat exchange tubes of the corrugated type having an inner heat exchange tube and an outer corrugated housing with a liquid filled cavity therebetween is that the rate of heat exchange per unit length of the heat exchanger is insufficient in some EGR applications.

Further, with the known corrugated heat exchanger, excessive boiling of coolant can occur.

There is a need for a compact coaxial cooler which has a high ratio of heat exchange per unit length to transfer more energy to the coolant with reduced EGR gas pressure drop whilst at the same time avoiding damaging levels of boiling within the cooler.

It is accordingly an objective of the present invention to maximize heat transfer from a hot gas to a liquid coolant using alternative cooling structures.

In addition, alternative cooling structures may experience harsh environmental conditions, such as significant temperature gradients, gas pressures, and gas velocities. It is therefore another objective of the present invention to minimize the risk of structural failures—such as cracking or fractures in components of the cooler—due to physical phenomena (e.g., thermal expansion), to increase the longevity and reliability coolers.

Manufacturing components for coaxial coolers typically involves a series of steps to turn raw materials into useful structures and arranging and securing those structures to form the coaxial cooler. Poor alignment or unwieldy components can increase manufacturing time and cost, while reducing manufacturing consistency and reliability of the coolers. Thus, a further objective of the present invention is to include physical features on alternative cooling structures that aid in the alignment and assembly of coaxial coolers.

These and other objectives and advantages will become apparent from the following detailed written description and figures.

SUMMARY OF THE INVENTION

According to a first aspect of the present invention, there is provided a heat exchanger for cooling hot gas using a liquid coolant, the heat exchanger comprising: a heat exchange tube for exchanging heat between the gas and the liquid coolant; a tubular outer body surrounding at least part of the inner heat exchange tube; wherein the gas flows through a passage in the heat exchange tube and the liquid coolant flows between the heat exchange tube and the tubular outer body; and one or a plurality of fins located inside the inner heat exchange tube, and contacting with an inner surface of the heat exchange tube.

The fins may act to increase heat exchange between the gas and the liquid coolant by transferring heat from the centre of the gas flow to the inner walls of the heat exchange tube, whilst not significantly increasing the gas pressure drop along the heat exchange tube.

Each fin may comprise an inwardly extending fin wall extending between an inner surface of the heat exchange tube and towards a main central axis of the heat exchanger.

A first plurality of fins may extend substantially radially inwardly towards a central axis of the heat exchanger to a longer radial distance than to each of a second plurality of fins, so as not to cause one fin to be in close proximity to another fin.

The main planes of the fin walls preferably extend in a direction parallel to the main axial length of a section of the cooler in which they are fitted. Preferably the main planes of the fin walls extend radially towards the main central length axis of the tube in which they are located so as to provide a plurality of individual gas passages surrounding a central gas passage having its centre coincident with a main central axis of the heat exchange tube, so that gas flows along the main central passage and along each of the individual gas passages surrounding the main central gas passage.

The heat exchange tube may consist of a number of substantially straight sections separated by a bent or curve section. At least one of substantially straight sections will be over least part of its length plain or smooth. At least one fin will be attached to the heat exchange over a length of the substantially straight plain section. Other straight sections may have a profiled surface that is used without a fin.

A straight section of the heat exchange tube may be plain over its full length and have at least one fin attached to it over the majority of the length.

A straight section may be a combination of a plain section with at least one fin attached and a section of profiled tube without a fin attached.

The profiled section may comprise helical or annular corrugations or individual forms that improve heat exchange where there is no fin.

A corrugated straight section may also be used to give the heat exchange tube some thermal or vibrational compliance.

The bent sections of the heat exchange tube do not have fins. The bent section may be plain, helically or annularly corrugated or have a profiled geometry to improve heat exchange.

The embodiments include a heat exchanger for cooling a hot gas using a liquid coolant, by utilising a coaxial cooler with an inner heat exchange tube and an outer body surrounding at least part of the inner heat exchange tube; the hot gas flowing through the heat exchange tube and the coolant flowing in an annulus between the heat exchange tube and the outer body tube; the heat exchange tube being smooth over at least part of its length, and having a fin or a series of fins joined to the inner surface of the heat exchange tube to increase heat exchange, whilst not significantly increasing gas pressure drop.

There may be fins having at least two different lengths, so as not to cause one fin to be in close proximity to another fin.

A plurality of fins are preferably formed from a single strip of material.

A plurality of fins may be arranged as a plurality of segments, each segment comprising at least one fin.

A plurality of fins may be manufactured from a strip of material such that the plurality of fins are formed into an arc of substantially less than 360°, when unconstrained and wherein the plurality of fins form an arc of nearly 360°, when constrained by insertion into a tube.

A plurality of fins may be manufactured from a single strip of material and may comprise a plurality of arcs wherein each arc has a radius greater than an internal radius of a tube into which the fin is designed to fit, so as to promote efficient heat transfer between the arcs of the fins and an internal surface of the tube. The tangent point of the radius of the corner of the fin may contact the heat exchange tube giving the shortest possible route for conduction of heat. When the fin is attached to the heat exchange tube with braze then the meniscus of the braze will further aid heat transfer by reducing the route for conduction and thickening the material width of the fin at its base.

The heat exchanger may comprise a compensation tube at one end of the heat exchanger to accommodate thermal growth and manufacturing tolerances.

The invention includes a gas to liquid heat exchanger comprising: at least one tubular section having therein one or a plurality of heat exchange walls or fins extending into a gas passage of the tubular section, the walls extending along a main length of the tubular section; and an outer jacket surrounding at least a part of the at least one tubular section, there being a cavity between said tubular section and the outer jacket within which the liquid may pass.

The invention includes a heat exchanger for cooling hot gas using a liquid coolant, the heat exchanger comprising: an inner heat exchange tube for exchanging heat between the gas and the liquid coolant; a tubular outer body surrounding at least part of the inner heat exchange tube; wherein the gas flows through the heat exchange tube and the liquid coolant flows between the inner heat exchange tube and the tubular outer body; and a fin member which fits inside the inner heat exchange member, the fin member comprising a plurality of substantially radially extending walls each extending along a main length direction of at least a portion of the inner heat exchange tube, and a plurality of substantially circumferentially extending connecting portions, each extending between adjacent ones of the substantially radially extending walls, and each connecting portion connecting a pair of the substantially radially extending walls; wherein the fin member is of dimensions such as to fit tightly within the inner heat exchange tube such that an outer surface of each the connecting portion is in contact with an inner surface of the inner heat exchange tube.

In a second embodiment of the present invention, the heat exchanger comprises at least one inner heat exchange tube for exchanging heat between said gas and said liquid coolant, in which the at least one inner heat exchange tube has an inner surface and an outer surface. In this embodiment, a tubular outer body surrounds at least part of said at least one inner heat exchange tube, in which the tubular outer body has both an inner surface and an outer surface. In this embodiment, the gas flows through the at least one inner heat exchange tube and the liquid coolant flows between the outer surface of the inner heat exchange tube and the inner surface of the tubular outer body. A substantially cylindrical corrugated sheet of material forming a plurality of fins is configured for orientation within the at least one inner heat exchange tube, with at least one of the fins positioned to be in contact with the inner surface of the inner heat exchange tube.

A particular fin of the plurality of fins may include a gap formed between a portion of the first end of the substantially cylindrical corrugated sheet and a portion of a second end of the substantially cylindrical corrugated sheet. The gap may exist as a result of the plurality of fins being formed from a single pressed and shaped piece of material, which may be rolled into a substantially cylindrical shape such that opposite ends of the sheet meet and form said gap.

The portion of the first end of the substantially cylindrical corrugated sheet may include one or more raised protrusions (which may be referred to herein as "locking clips") that at least partially overlap the portion of the second end of the substantially cylindrical corrugated sheet. Locking clips may friction fit with portions of the substantially cylindrical corrugated sheet opposite thereof, mechanically securing the corrugated sheet in a substantially cylindrical shape.

The fins may include undulations for increasing turbulence in the gas, each of said undulations oriented along the longitudinal axis of said inner heat exchange tube. The undulations may be periodic, sinusoidal in shape, or otherwise be substantially nonlinear in a direction of the longitudinal axis of the inner heat exchange tube for increasing turbulence in the gas.

At least one of the plurality of fins may include one or more radially-extending slots. The slots may form "V" shaped gaps extending radially from a radially inward fin tip toward adjacent radially outward fin tips. There may be any number of slots spaced apart along the longitudinal direction of the plurality of fins. The slots may have either uniform or non-uniform width, as measured along the longitudinal axis of the inner heat exchange tube. The slots may be "bulb" shaped, in that they include a straight portion and a circular segment portion which collectively form an "omega" or bulb-shaped gap. In some implementations, the one or more radially-extending slots have a minimum width of at least 0.2 millimeters over at least a portion of the slot.

A heat exchanger may include a substantially cylindrical corrugated sheet of material having fins of two or more lengths. In some embodiments, the substantially cylindrical corrugated sheet may include three different fin types, each having different lengths respectively. As described herein with respect to fin types, "length" may refer to the radial distances of the fin "walls" (which extend radially outward) between radially-inner fin tips and adjacent radially-outer fin tips.

In the present invention, some of the heat exchangers may include tubular bellows structures operably affixed to at least one end of said inner heat exchange tube. The tubular bellows may include an outer lip that at least partially overlaps the tubular outer body. The tubular outer body might include an angled protrusion extending radially outward from the tubular outer body, wherein a distal end of the outer lip abuts the angled protrusion. The angled protrusion (also referred to herein as an "angled retention feature") may encourage the flow of braze paste toward the joint formed between the outer lip and the angled protrusion during the brazing process.

The tubular bellows may be positioned radially outwardly from the inner heat exchange tube at a position such that the substantially cylindrical corrugated sheet of material forming the plurality of fins may not positioned radially thereunder. In other words, the tubular bellows may or may not surround the portion of the inner heat exchange tube containing the fin assembly, depending upon the particular implementation.

In a third embodiment of the present invention, the heat exchanger comprises a plurality of finned heat exchange tubes (sometimes referred to herein as coaxial coolers) arranged substantially parallel to each other. Each coaxial cooler includes an inner heat exchange tube for exchanging heat between said gas and said liquid coolant, each having both an inner surface and an outer surface. For each coaxial cooler, a portion of said gas flows through the respective inner heat exchange tube. Each coaxial cooler also includes a plurality of fins contacting the inner surface of said respective inner heat exchange tube. In this embodiment, the plurality of coaxial coolers are collectively surrounded by at least one tubular outer body having an inner surface and outer surface. In this embodiment, the liquid coolant flows between the outer surfaces of said inner heat exchange tubes of the plurality of coaxial coolers and the inner surface of said tubular outer body.

In some embodiments of the present invention, each of the plurality of fins may be formed from a substantially cylindrical corrugated sheet of material. A particular fin of the plurality of fins of a given coaxial cooler may include a gap formed between a portion of a first end of the substantially cylindrical corrugated sheet and a portion of a second end of the substantially cylindrical corrugated sheet.

The portion of the first end of the substantially cylindrical corrugated sheet may include one or more raised protrusions that at least partially overlap the portion of the second end of the substantially cylindrical corrugated sheet.

One or more of the plurality of fins of a given coaxial cooler may include undulations for increasing turbulence in the gas, with each of the undulations oriented along the longitudinal axis of said tubular outer body.

One or more of the plurality of fins of a given coaxial cooler may have a substantially nonlinear shape in a direction of a longitudinal axis of said tubular outer body for increasing turbulence in the gas.

At least one of the plurality of fins of a given coaxial cooler may include one or more radially-extending slots. These slots may have a non-uniform width, as measured along the longitudinal axis of said tubular outer body.

The plurality of fins of a given coaxial cooler may include a first, a second, and a third fin type. Each of the first, second, and third fin types may have different radial lengths respectively, and may extend inwardly by different radial distances towards the longitudinal axis of said tubular outer body.

Other aspects are as set out in the claims herein.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE EMBODIMENTS

There will now be described by way of examples several specific modes of the invention as contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

In this specification, the embodiments described are heat exchangers aimed at exchanging heat between a gas and a liquid. In various embodiments, the heat exchangers described are coolers which cool a hot gas using a liquid coolant. It will be understood by the skilled person that a cooler is a type of heat exchanger.

The coolers described herein are particularly although not exclusively aimed at providing pre-cooling prior to a valve component in an internal combustion exhaust gas recirculation circuit. In this application, the cooler is fitted in an EGR circuit between an exhaust manifold and an exhaust gas recirculation valve or an EGR cooler, from which the recirculated gas is fed back into an inlet manifold of the internal combustion engine. However, in other applications, the cooler embodiments described herein may be suitable for long route circuit exhaust gas recirculation systems, in which an exhaust gas is sampled downstream of a catalytic converter and is reintroduced into an air inlet of an internal combustion engine upstream of the compressor.

Figure 1:
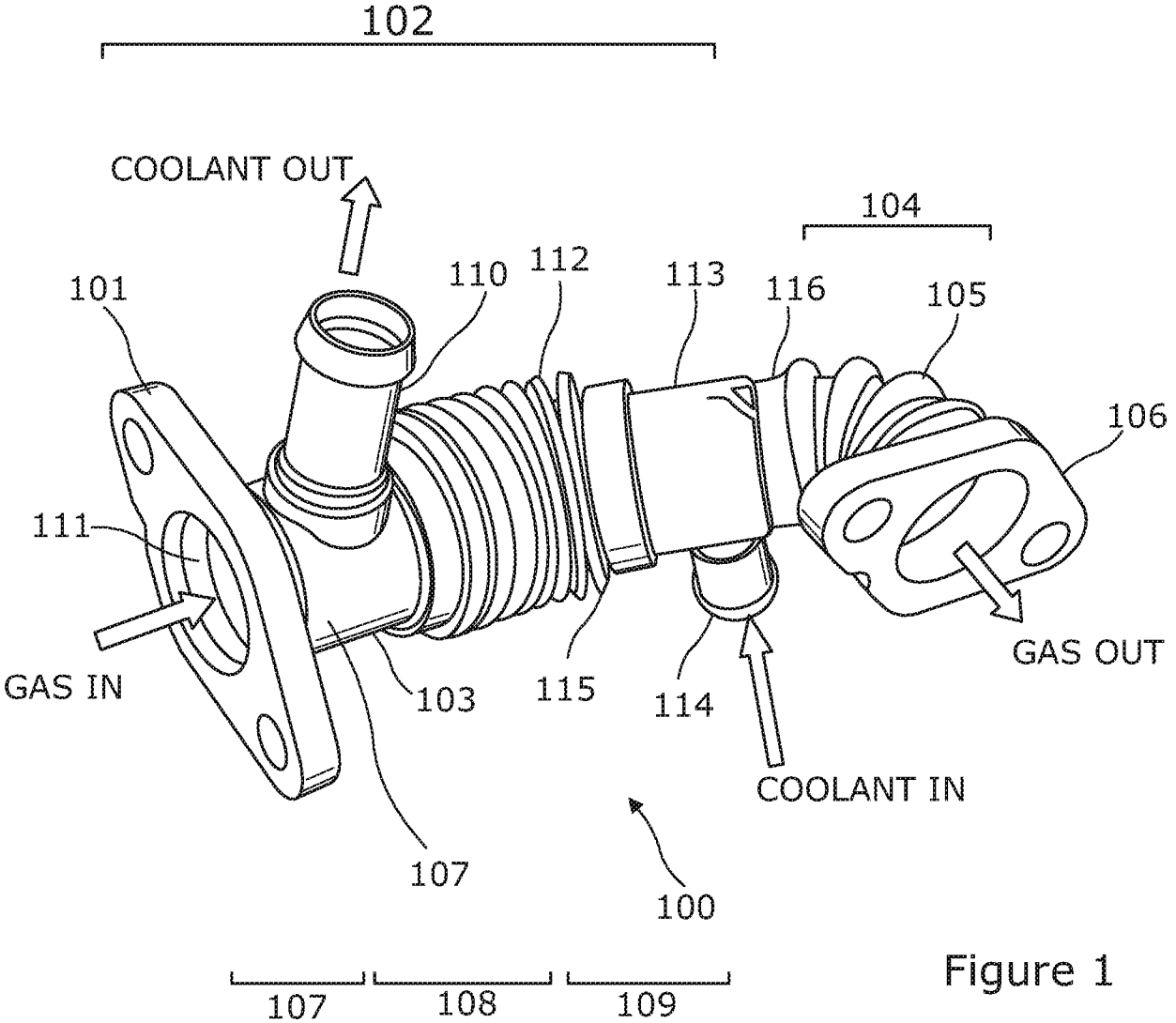
FIG. 1 shows schematically in perspective view a first cooler according to a first specific embodiment heat exchanger.

In the following description a flow of coolant is shown and described in a first direction as indicated by the arrows in FIG. 1 herein, but it will be appreciated that the coolant flow can be reversed so the coolant flows through the cooler in the opposite direction. Similarly, a gas flow direction is shown in a first direction in FIG. 1 herein, opposite to the general direction of coolant flow, but it will be appreciated that the direction of gas flow can be reversed. The cooler can be connected in a gas circuit so that the gas flow is either in the first gas flow direction of FIG. 1, or alternatively in the opposite direction. Similarly the coolant flow can be connected in the first coolant flow direction as shown in FIG. 1 herein, or alternatively in the opposite direction. The efficiency of heat transfer between gas and liquid coolant may be optimal when the gas and coolant flows are connected in opposite general directions to each other and as shown in FIG. 1 herein.

Figure 2:
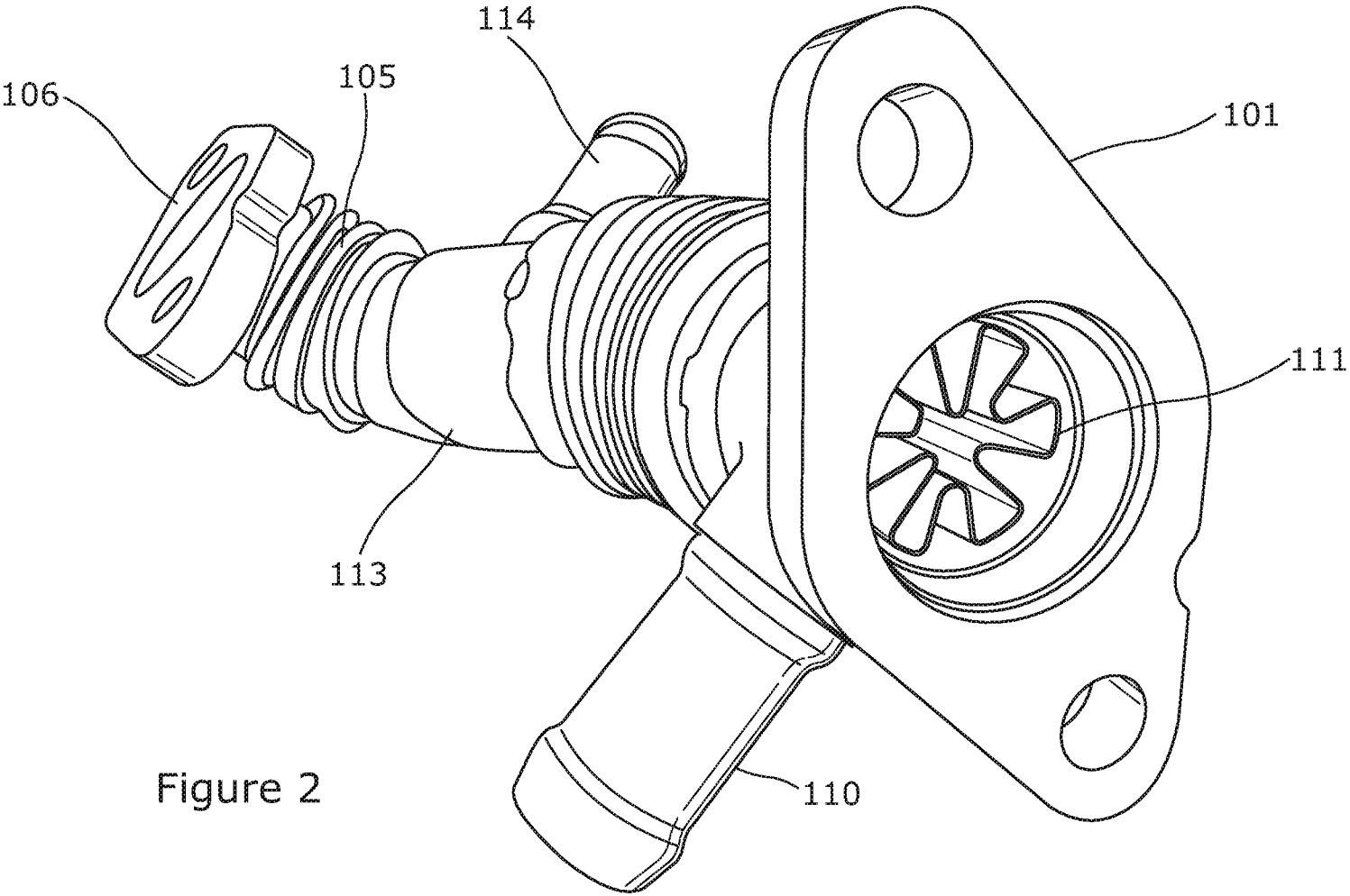
FIG. 2 shows the first cooler in perspective view from a first end.
Figure 3:
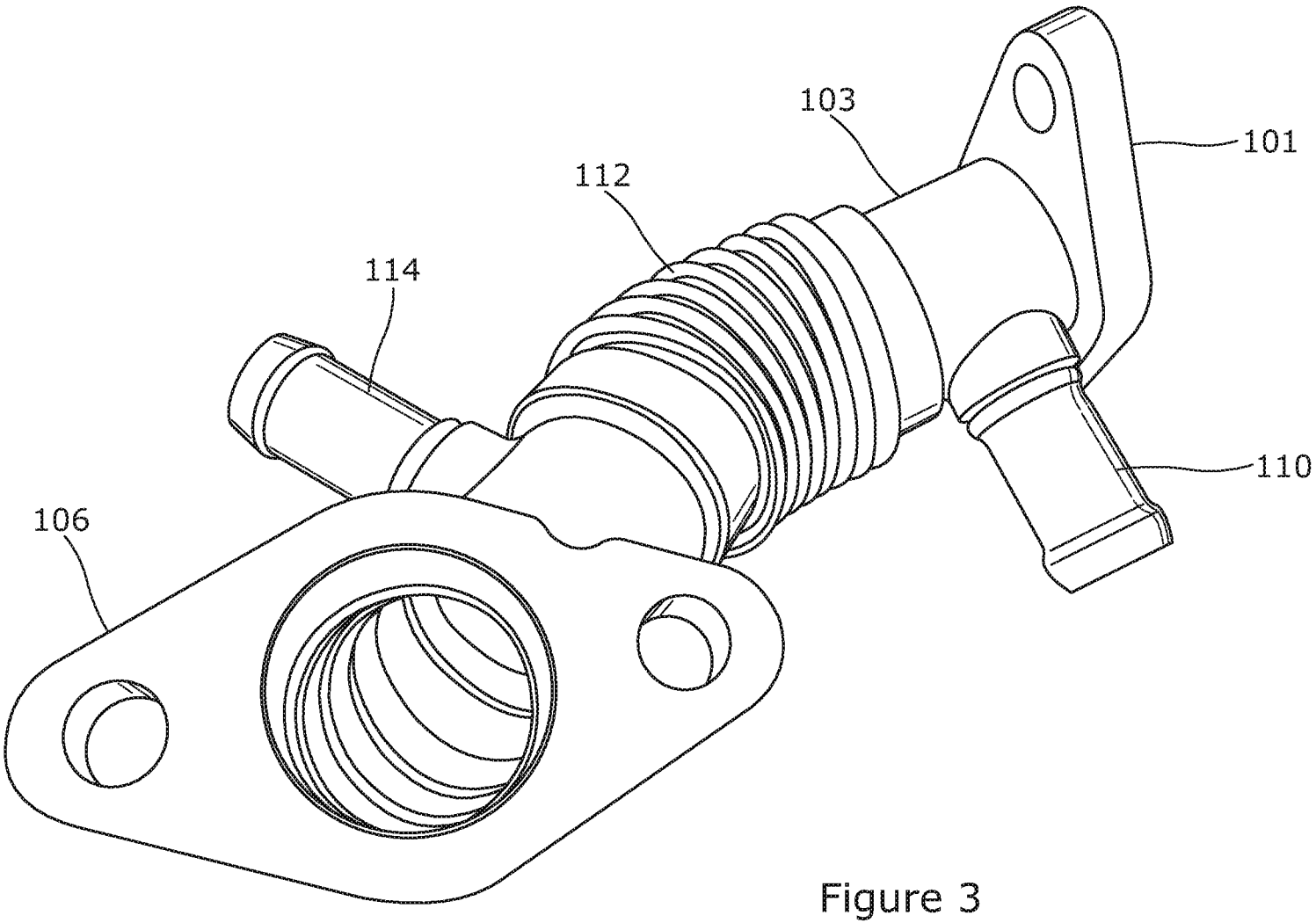
FIG. 3 herein shows the first cooler in perspective view from a second end.

In the embodiments described herein, a hot gas flow is shown as passing centrally through a liquid coolant flow, where the liquid coolant flow is contained within an outer jacket which surrounds a central heat exchange tube through which the gas passes, and the gas and liquid are separated by the thin metal walls of the heat exchange tube Referring to FIGS. 1 to 3 herein, there is shown three views of a co-axial cooler 100 according to a first specific embodiment. The cooler comprises a tubular gas passage for flow of gas therethrough, and a tubular outer jacket surrounding part of the length of the gas passage, there being a cavity between the inner tubular gas passage and the outer jacket, so that a liquid coolant can flow in the cavity between the inner tubular gas passage and the outer jacket, to cool part of the inner tubular gas passage. At one end of the cooler, there is a further connecting section 104 which is single walled and does not have an outer jacket, which is cooled by external ambient air.

One use of the cooler is to cool the exhaust gas flow immediately prior to entering the exhaust gas recirculation valve component. In use, the cooler component is fixed in an exhaust gas recirculation circuit of an internal combustion engine by connecting first and second ends of the cooler within the circuit. The cooler is inserted between an exhaust manifold of the internal combustion engine, and an exhaust gas recirculation valve.

The cooler 100 comprises: at a first end, a first flange 101 for connecting the first end of the cooler into a gas flow circuit; a liquid cooled section 102 having an inner tubular passage and an outer tubular jacket 103 in which a liquid coolant passes between the inner tubular passage and the outer tubular jacket in order to cool the inner tubular passage; an air cooled section 104 comprising a tubular bellows member 105; and at a second end of the cooler, a second flange 106 for connecting a second end of the cooler into said gas flow circuit.

The liquid cooled section outer coolant jacket 102 comprises a first straight substantially circular cylindrical section 107; a flexible corrugated central section 108 that has a straight and a bent portion; and a second straight substantially circular cylindrical section 109.

The first straight section 107 comprises a first outer substantially circular cylindrical tube 103; and a first inner substantially circular cylindrical tube. Extending transverse to the main axial length of the first section is provided a coolant outlet tube 110 for draining coolant from the first tubular section. A first end of the first outer tube is secured to the first flange 101 by welding or brazing the end of the outer tube to the flange at a position surrounding a circular aperture in the flange, and a first end of the first inner tube is also secured to the first outer tube 103 by welding or brazing to the inside of said circular aperture in the end of the flange, so that the inner and outer first tubes are coaxial with each other and have a substantially annular cavity therebetween. Liquid coolant enters the annular cavity at a second end of the straight section where the straight section joins with the flexible corrugated central section 108, and can pass through the annular cavity between the inside of the first outer tube and the outer surface of the first inner tube and can flow out of the coolant outlet tube 110.

Within the first straight inner tube there is provided a first finned insert member 111 which separates the interior of the first straight inner tube into a plurality of radially extending gas passages extending along a length of the first straight section.

The flexible corrugated central section 108 comprises a first outer corrugated tubular bellows member 112, the inner tube member being inside and concentric with the outer bellows member so that there is a cavity therebetween which completely surrounds the inner member and through which liquid coolant can flow. The corrugated central section 108 is sufficiently flexible to absorb thermal growth of the inner member during use of the cooler. A first end of the central corrugated section 108 is fixed to the second end of the first straight section 107, and a second end of the central corrugated section is attached to a first end of the second straight section 109.

The second straight section 109 comprises a second outer substantially circular cylindrical tube 113; a second inner substantially circular cylindrical tube located coaxially within the second outer cylindrical tube 113; and a coolant inlet tube 114 through which coolant can be passed into the second straight section 109. The inner heat exchange tube has a finned section that is not visible. A first end 115 of the second straight section 109 is fixed to a second end of the central corrugated section 108 and a second end 116 of the second straight section 109 is connected to a first end of the second section 104. The corrugated section 108 has the second ends of its respective inner and outer corrugated tubes connected in gas and liquid tight manner to the corresponding respective first ends of the second straight inner and outer tubes. The second ends 116 of the second inner and outer tubes are welded or brazed together so that the two tubes are located coaxially with each other and with an annular cavity there between through which liquid coolant passes.

Figure 25:
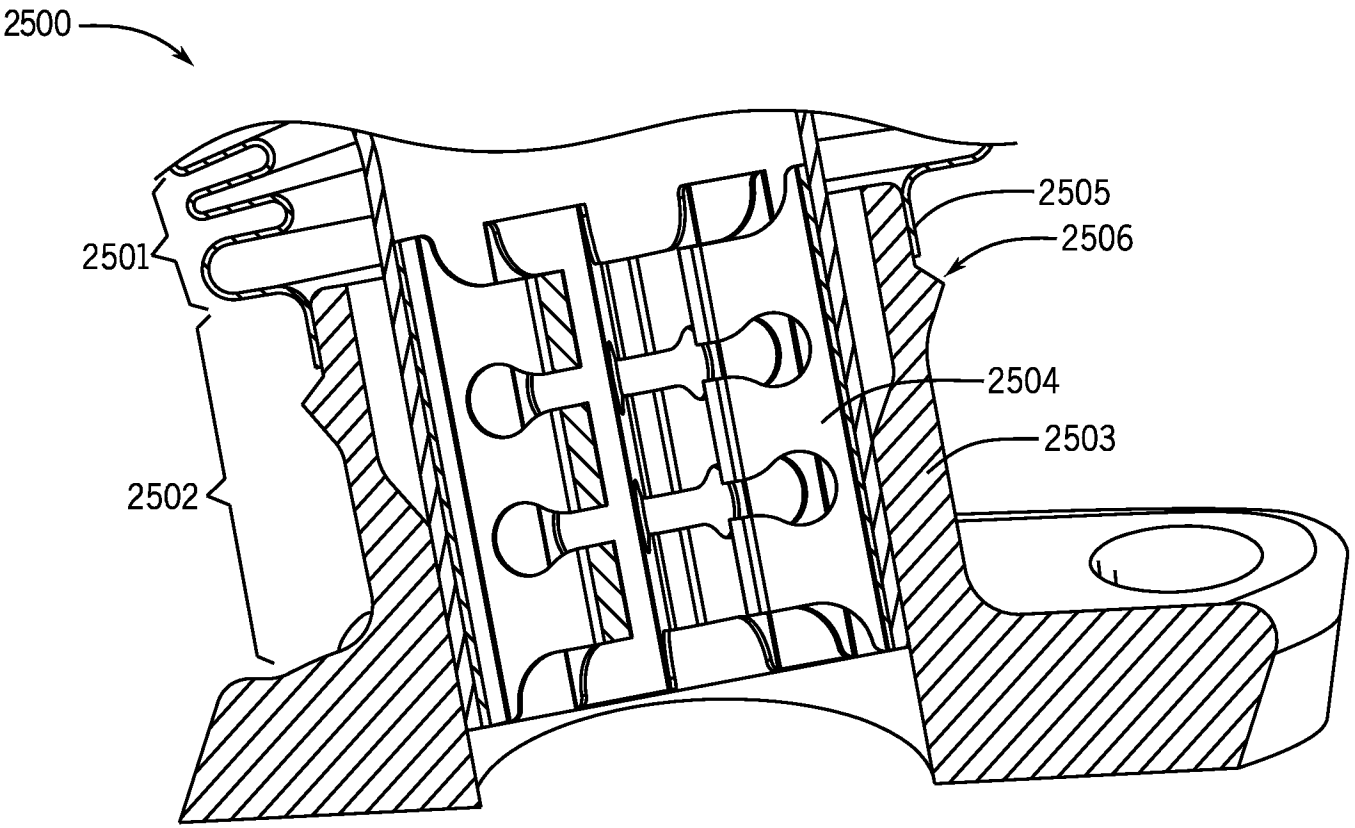
FIG. 25 depicts a portion of a cooler 2500 where tubular bellows section 2501 is retention fit adjacent to coaxial cooler.

In some implementations, the tubular bellows member 112 may include one or more outer lips (at opposite coaxial ends of tubular bellows member 112), that at least partially overlap with portions of adjacent outer tubular jacket 103 and/or second outer substantially circular cylindrical tube 113. The adjacent outer tubular jacket 103 and/or second outer substantially circular cylindrical tube 113 may include a protrusion extending radially (also as shown in FIG. 25 as angled retention feature 2506), which may act as a retention and/or alignment feature against which the outer lip can operably abut. In some embodiments, the protrusion may form an angle between 15 degrees and 75 degrees with respect to the longitudinal axis of the portions of adjacent outer tubular jacket 103 and/or second outer substantially circular cylindrical tube 113. During assembly of cooler 100, the angled protrusion or retention feature may encourage braze paste to flow toward the joint formed by an outer lip and the angled protrusion.

Inside the inner tube of the second straight section 109 there is provided a second finned member which separates the interior of the second straight inner tube into a plurality of radially extending gas passages extending along a length of the second straight section, similarly to the first finned member 111 in the first straight section 107.

Although first finned member 111 is shown to include six fins, with three fins of a first length and three fins of a second length, other embodiments may include fin members having other numbers of fins, having various lengths and/or shapes. Some fin geometries may be rounded and form curved petals, while other fin geometries have well-defined edges (e.g., folds in a metal sheet). Various fin members described herein may include additional features, such as slots to account for thermal expansion of the fin member, or locking clips to hold the fin member in a substantially cylindrical shape, among other possible features.

Within the first and second straight portions 107, 109, there is provided said first and second finned members, however the bent section of the central corrugated section 108 does not contain an internal finned member. The corrugated section 108 has a degree of thermal compliance due to the outer corrugated bellows part which is capable of absorbing thermal growth during operation of the cooler.

The air cooled section 104 is primarily aimed at providing a compensation portion to absorb differences in manufacturing tolerances, vibration and thermal growth of the cooled section 102. The gas cooled section 104 comprises a single wall corrugated bellows member 105, a first end of which is connected to a second end of the second straight section 109, and a second end of which is connected to the second flange member 106. The second section 104 has a degree of flexibility due to the corrugated bellows part 105 which is capable of absorbing vibration and thermal growth during operation of the cooler.

The cooler heat exchange tube therefore comprises alternating straight sections and bent sections along its length, wherein the straight sections have internal finned structures providing heat transfer surfaces which are aligned in an axial direction along the flow of gas.

In a variation, the second section 104 may be deleted and instead a corrugated bend and short length of straight on the heat exchange tube may be used. This, together with the corrugated outer tube give a component capable of absorbing build tolerances, vibration and thermal growth.

Referring to FIG. 2 herein, there is shown the first end of the cooler in which the first finned structure 111 can be seen inserted into the inner tube of the first straight section. The first finned structure comprises a tubular metal component having in the radial direction a plurality of flower petal shaped undulations, so that a single central passage of the fin component presents a substantially flower shape central gas passage as viewed in the main direction of gas flow surrounded by a plurality of substantially triangular or trapazoid shaped peripheral gas passages between the fin member and the internal wall of the heat exchange tube. The finned component is inserted into the inner straight tube, so that between the fin component and the inner wall of the inner tube there are created a plurality of outer gas passages separated circumferentially from each other by the fin component, the outer passages separated from the central inner passage by the walls of the fin component. The walls of the fin component extend axially along the length of the straight section to present a first plurality of heat transfer walls which are radial to the straight section, and which are substantially parallel to the axial gas flow, and a second set of circumferential heat transfer walls which are concentric with and in contact with the inner cylindrical wall of the inner tube, and which extend axially along the length of the inner tube, one side of each said circumferential wall being in contact with the gas flow and another side of each said circumferential wall being in contact with the inner wall of the inner tube.

Referring to FIG. 3 herein, there is shown the cooler in perspective view from the second end, showing the inside of the single walled corrugated tube 105 of the end section 104. Inside the second straight section 109, there is a corresponding finned member similar to the finned member 111 in the first-rate section, which is just out of view in the view of FIG. 3.

Figure 4:
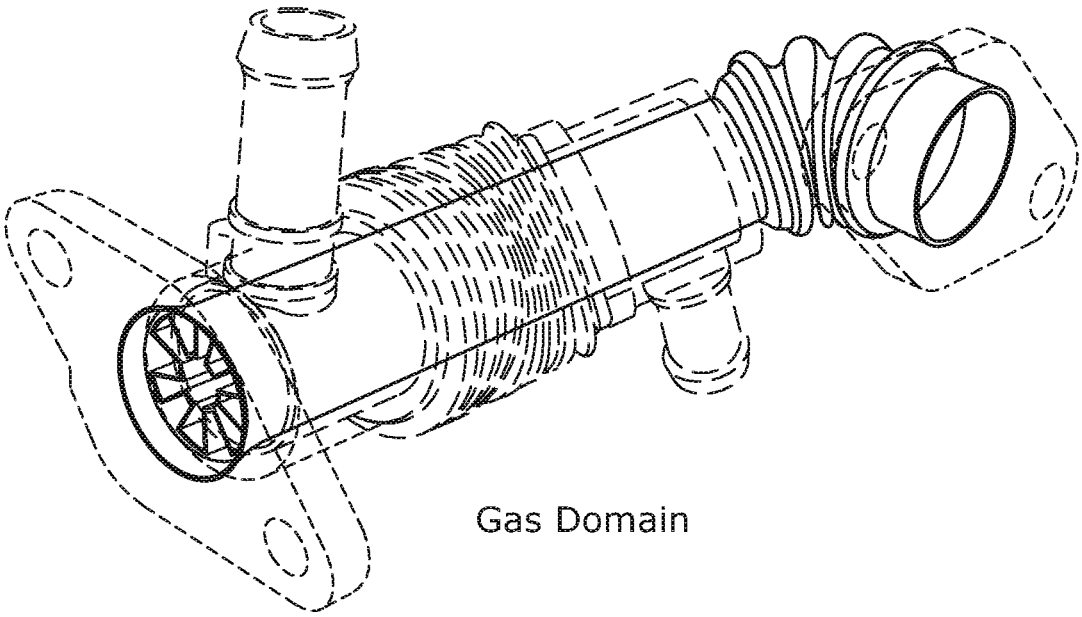
FIG. 4 shows schematically the first cooler in perspective view showing a gas domain of the first cooler.

Referring to FIG. 4 herein, there is shown in perspective view the first embodiment cooler, showing a gas domain, being component parts and surfaces of the cooler which are in direct contact with the gas to be cooled, and to which heat is directly transferred by said gas. The gas domain comprises an inner surface of: the inner tubular parts of the first section 102, the first set of internal fins 111, the second set of internal fins; and an inner surface of the air cooled section 104.

Figure 5:
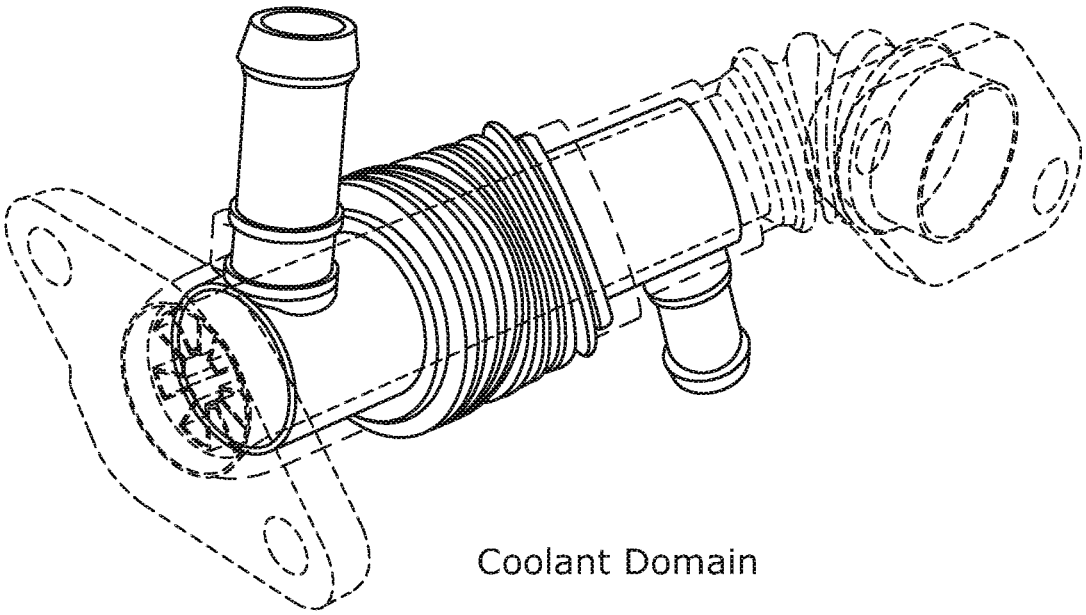
FIG. 5 shows schematically the first cooler in perspective view showing a coolant domain of the cooler.

Referring to FIG. 5 herein, there is shown a view of the first embodiment cooler which shows a coolant domain, being component parts and surfaces of the cooler which are in direct contact with the liquid coolant and to which heat is transferred from the component parts to the liquid coolant. The coolant domain comprises inner surfaces of: the outer jacket comprising first outer straight tube 103, outer corrugated tube 112, and second outer straight tube 113; outer surfaces of the first straight inner tube, the inner bent tube, and the second inner straight tube, the coolant outlet tube 110 and the coolant inlet tube 114. The coolant domain comprises the whole of the internal cavity in the straight sections and corrugated section of the first section 102 together with the coolant inlet tube and the coolant outlet tube.

As seen in FIG. 5, along the length of the cooler the coolant domain extends in parallel with the gas domain over part of the length of the gas domain, whereas the gas domain extends over substantially the entire length of the coolant domain. The gas domain runs centrally through the coolant domain.

Although FIGS. 4 and 5 show the gas domain as containing a single inner tubular part and a single set of internal fins, other embodiments of the present disclosure may include an array of inner tubular parts and internal fin assemblies which may be collectively surrounded by an outer tube. In such embodiments, coolant may flow through the coolant inlet tube and pass through a cavity defined by the outer tube that enclose two or more substantially parallel inner tubular parts. In this manner, hot gas may be separated into two or more substantially parallel inner tubular parts, thereby increasing the effective surface area between the gas and the liquid coolant, in turn encouraging greater heat exchange compared to single inner tubular part and fin arrangements.

Internal Fins

In the first embodiment cooler, the internal fins each comprise a substantially radially extending wall extending between an inner wall of the substantially straight inner tube and a position near the centre of the gas passage through the inner tube. The walls extend axially along a length of the inner tube, and project inwardly into the central gas passage.

A plurality of said internal fins may be provided as part of a fin member. Each fin member comprises a plurality of substantially radially extending walls joined together at their radially outermost positions by a plurality of substantially arced cylindrical walls.

In a conventional tubular gas to liquid heat exchanger, having passage of a gas through a tubular member, heat exchange occurs only on the inner facing wall of the tubular member, this being the only place where gas comes into contact with the material of the tubular member. However, by providing a plurality of fins as described herein, this provides further heat exchange surfaces which the gas may come into contact with. Heat transferred from the gas to the fins passes by conduction along the material of the fin, heating up the whole fin and reaches a position where the fin contacts the inner wall of the tubular member. Heat is transferred by conduction from the fin member to the inner wall of the tubular member, through the material of the tubular member, and to the coolant on the other side of the tubular member, where the outer surface of the tubular member comes into contact with the liquid coolant.

Hence, the overall surface area in the central passage of the tubular heat exchange member which comes into contact with the gas flow and through which heat can be exchanged between the material of the heat exchanger and the gas is increased by provision of the fins in the heat exchange tube.

Figure 6:
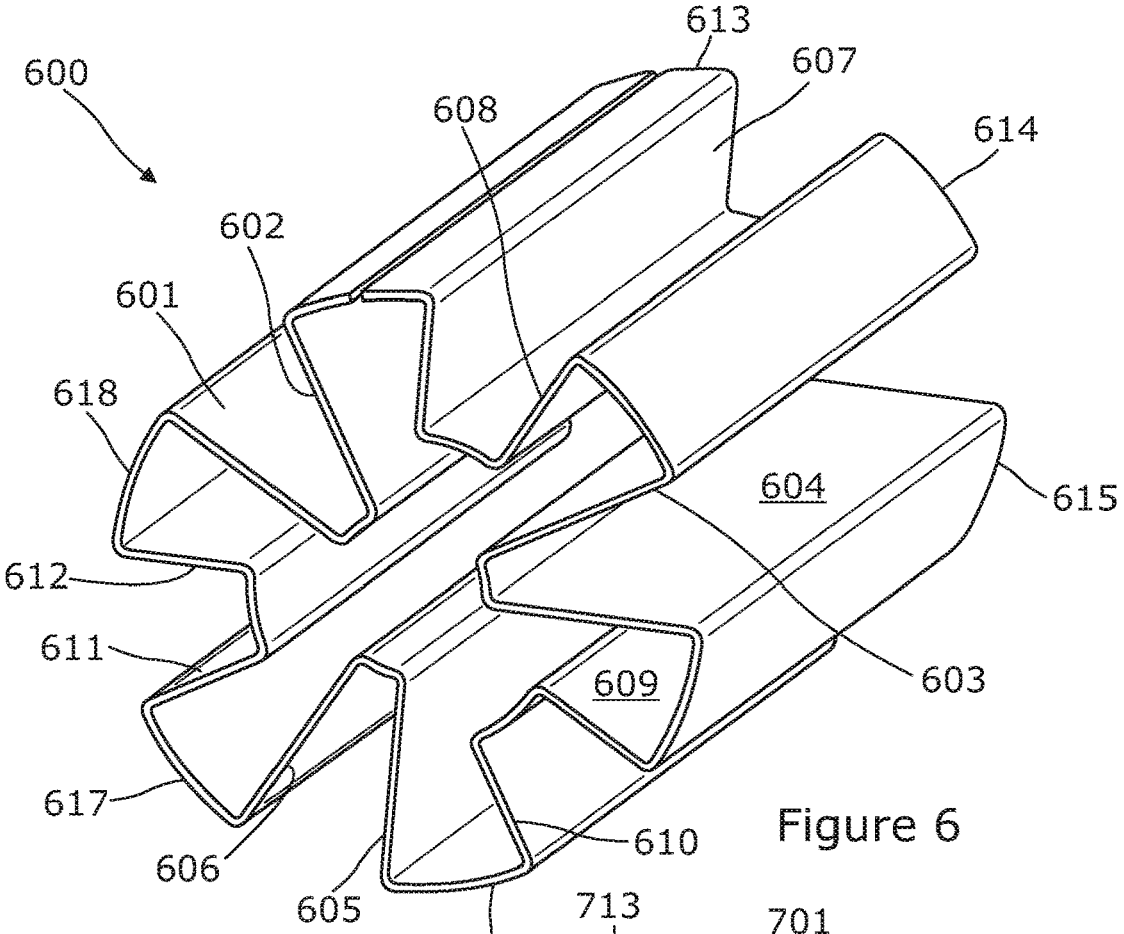
FIG. 6 herein shows schematically a first fin assembly according to a first embodiment fin assembly.

Referring to FIG. 6 herein, there is shown in perspective view a first fin assembly 600. The fin assembly is shown in its condition when inserted into the heat exchange tube. Prior to insertion the fin assembly is more open, (see FIGS. 15 and 16 herein). The first fin assembly is formed from a single strip of initially flat metal having a smooth surface on both sides. The strip is formed into a fin member which is shaped to fit into a circular cylindrical outer boundary (for example an inner surface of a circular cylindrical heat exchange tube). The first fin assembly comprises a plurality of substantially radially inwardly extending longer first fin walls 601-606; a plurality of substantially radially inwardly extending shorter second fin walls 607-612; a plurality of part circular cylindrical or arced outer connecting walls 613-618; a plurality of part circular cylindrical first inner connecting walls 619-621 each of which connects together the radially inward lower ends of a pair of adjacent first fin walls; and a plurality of part circular cylindrical second inner connecting walls 622-624 each of which connects together the radially inward lower ends of a pair of adjacent second fin walls.

Figure 7:
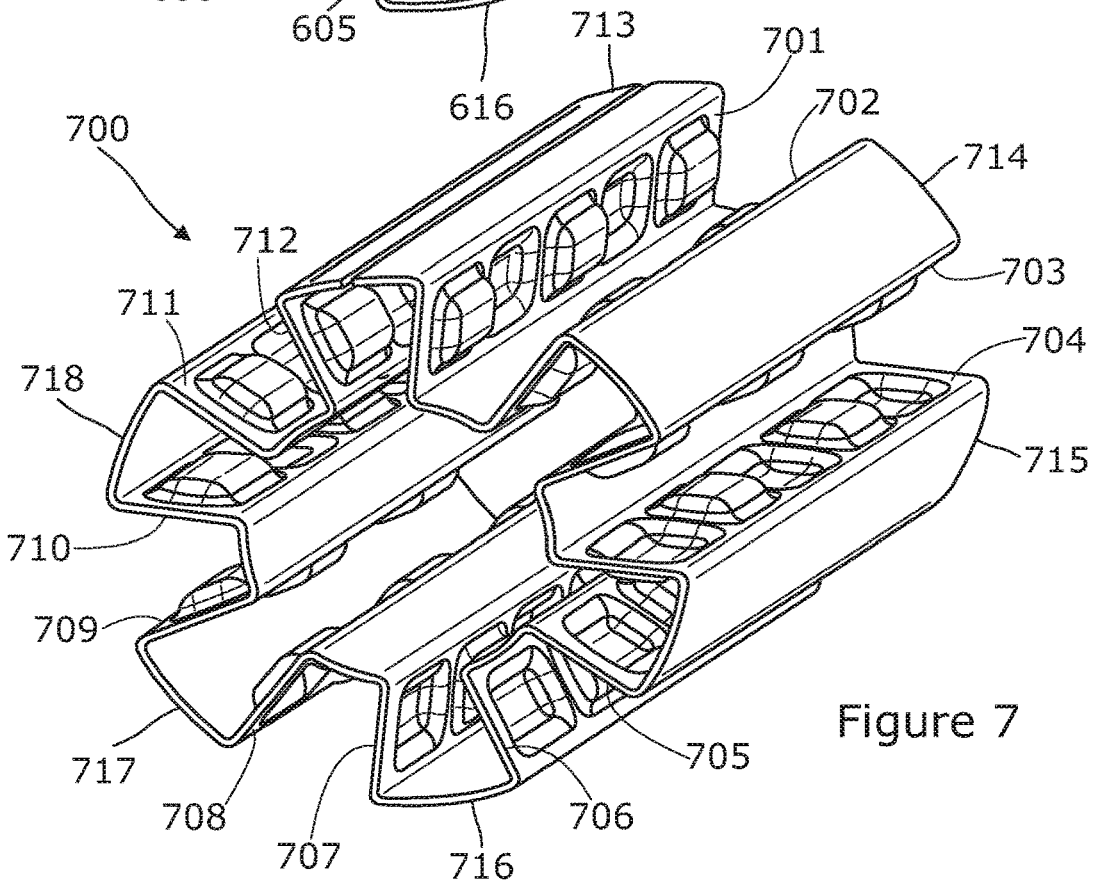
FIG. 7 herein shows a second fin assembly according to a second embodiment fin assembly.
Figure 9:
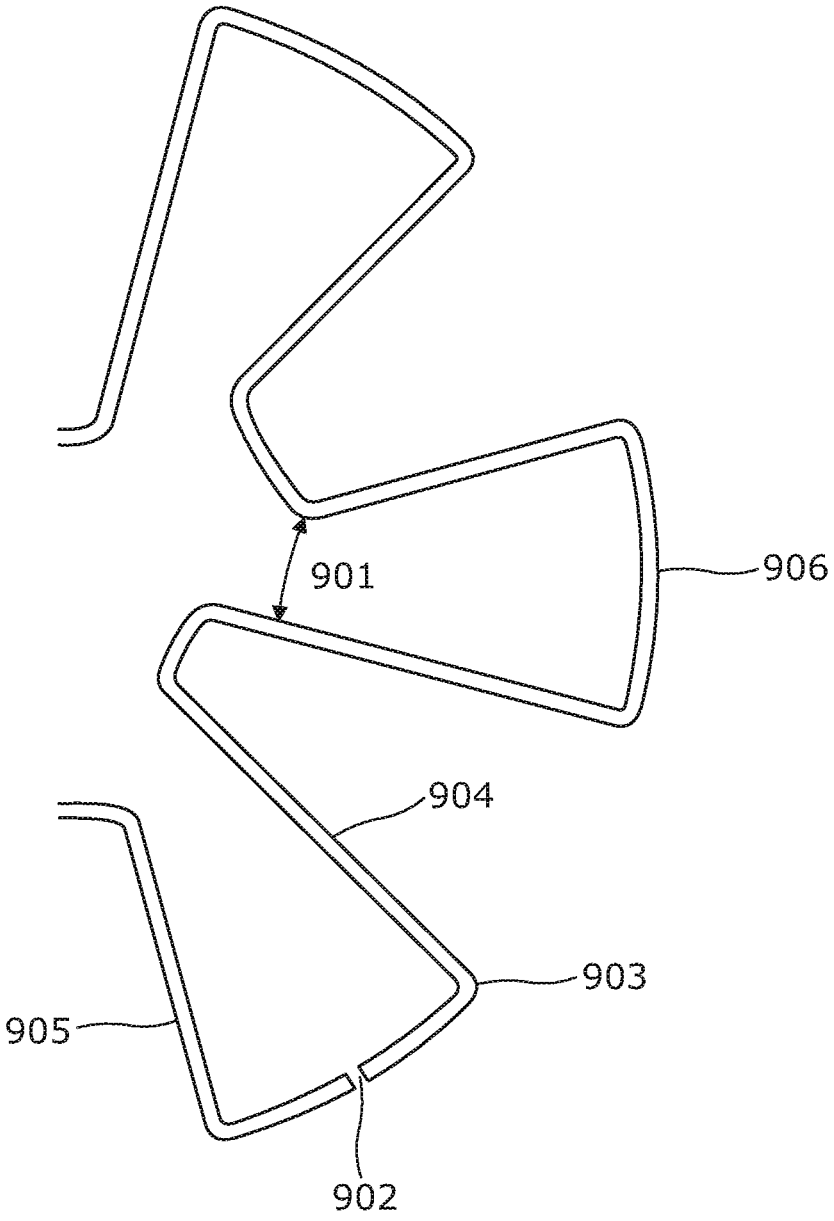
FIG. 9 shows part of the first fin assembly viewed from its end.

FIGS. 6, 7 and 9 show the inner connecting walls to form parts of a circle. For ease of manufacture FIG. 9 shows the inner connecting walls to be a radius between the fin walls.

The inwardly facing surfaces of the first inner connecting walls, facing inwardly towards the central axis of the fin member, lie substantially on a first circular cylinder. The inwardly facing surfaces of the second inner connecting walls, facing inwardly to a central axis of the fin member, lie substantially on a second circular cylinder. The inwardly facing surfaces of the second inner connecting walls lie radially inwardly relative to the inwardly facing surfaces of the first inner connecting walls, so that the plurality of first fin walls extend radially further inwards from an outer circumference of the fin member compared to the plurality of second fin walls.

The fin member is manufactured from a single elongate substantially flat smooth sided piece of metal which is formed into the substantially flower shaped cross-sectional form as shown in FIG. 6. The single elongate strip of metal is folded such that a first end and a second end of the metal strip form a first outer connecting wall 613. The fin member is formed such that the outside diameter of the component in an unrestrained state, where the fin member is not inserted into a heat exchange tube is larger than the outside diameter of the component in a constrained state when the component is fitted inside a heat exchange tube. The fin when fitted inside the heat exchange tube does not form a full 360° as shown by connecting wall 613. There is a small gap between the two ends of the material to allow for ease of insertion and tolerances.

Figure 24:
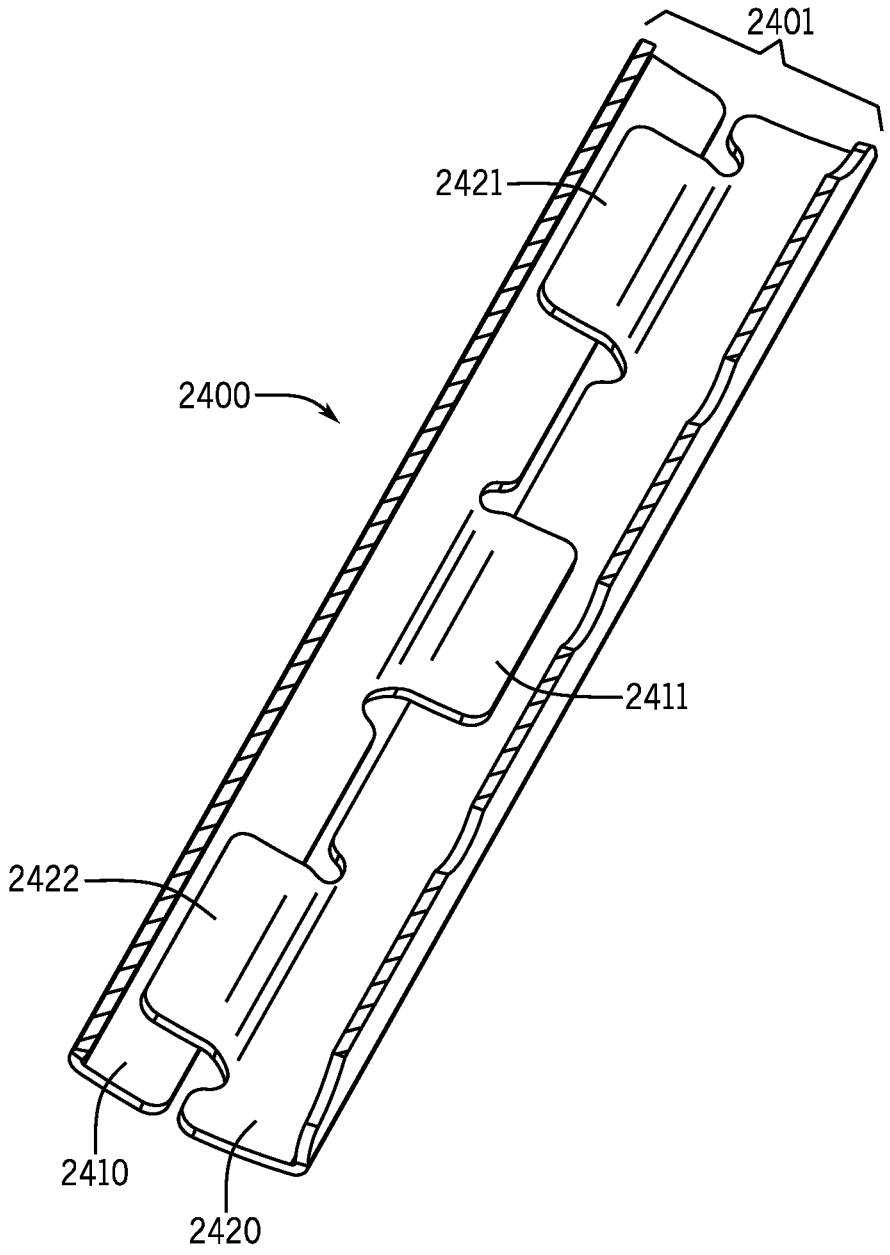
FIG. 24 illustrates an example set of locking clips.

In some embodiments, the small gap shown along connecting wall 613 may include a set of raised tabs, protrusions, or "locking clips" as shown in FIG. 24. These locking clips extend circumferentially from either end of the gap toward the opposite end of the gap. The protrusions may be raised in either the radially outward direction (to slide on the outside of the opposite end of the connecting wall) or in the radially inward direction (to slide on the inside of the opposite end of the connecting wall). The protrusions may have dimensions that create an interference or friction fit with the opposite end of the connecting wall. When assembled, the raised protrusions may act to secure the fin member in a substantially cylindrical shape to prevent it from unrolling and to maintain a consistent gap width, which may be beneficial for some assembly or manufacturing processes.

The fin member may be formed of a resilient metal material, such that once formed, it has a resilience and a tendency to expand into its as—formed shape, such that when fitted inside a heat exchange tube and therefore compressed to a slightly smaller diameter circular cylinder, the outer circumferential surfaces 613-618 of fin member contact with, and are urged radially outwardly against, the inner circular cylindrical surface of a heat exchange tube, thereby ensuring good thermal contact between the fin member and the wall of the heat exchange tube.

In order to fit the fin member into a substantially straight circular cylindrical heat exchange tube, the fin member will be compressed from its more open form to the diameter of the heat exchange tube and then may be slightly compressed in the circumferential direction, slid into the inside of the heat exchange tube, and released. The resilience of the metal material of the fin member causes the fin to expand outwards on to the heat exchange tube diameter and retain itself by friction inside the heat exchange tube. However, as a further stage of manufacture, the circumferentially extending faces 613-618 may be brazed, welded or soldered to the inner facing wall of the heat exchange tube, either at the axial ends of the fin member, and/or along the edges between the first radially extending fins 601-607 and a corresponding respective outer circumferential surface 613-618.

Having alternate pairs of relatively longer and relatively shorter radially extending fins prevents adjacent pairs of fins being located in too close proximity to each other, and thereby minimizes the effect of resistance to gas flow, thereby minimizing the effect of pressure drop and improving heat exchange, and minimizes the incidence of the inward tips or edges of the fins and the inner circumferential extending surfaces becoming clogged with exhaust gas solid/liquid pollutants.

In the case of the first fin assembly, there are provided a first plurality of gas passages between the fin assembly and the inner walls of the heat exchange tube which extend in a circumference around the second circular cylinder. A central gas passage is formed in a substantially flower petal shape when viewed along a main axis of the heat exchange tube, said central gas passage comprising a substantially circular cylindrical central passage having a plurality of radially extending segments arranged around said substantially circular cylindrical central passage.

Referring to FIG. 7 herein, there is illustrated schematically in perspective view a second fin assembly 700. The second fin assembly is manufactured from a single strip of initially flat metal having a smooth surface on both sides. The fin member is shaped to fit into a circular cylindrical outer boundary, for example an inner surface of a circular cylindrical heat exchange tube. The second fin assembly comprises a plurality of substantially radially inwardly extending fin walls 701-712; a plurality of part circular cylindrical outer connecting walls 713-718 extending in an outer circumference, each of which connects together the radially outer edges of a pair of adjacent first fin walls; a plurality of part circular cylindrical first inner connecting walls 719-721 extending in an inner circumference, each of which connects together the radially inward lower edges of a pair of adjacent first fin walls.

The inwardly facing surfaces of the inner connecting walls 719-721, face inwardly towards a main central axis of the fin member and lie substantially on a first circular cylinder. The outer surfaces of the outer connecting walls 713-718 face outwardly radially away from the main central axis and lie on a second outer circular cylinder. In use, these outer surfaces are in contact with the inner surface of the central heat exchange tube so that heat can exchange between the fin member and the wall of the inner heat exchange tube.

Along the axial length of each fin, the fin wall is formed into a plurality of protruding dimples or mounds which protrude circumferentially into the gas flow between adjacent fins. Each fin wall comprises alternating dimples formed successively to one side and then to another of the main plane of the fin wall, so that as gas flows along the passage bounded by the thin walls, the dimples or mounds cause turbulent gas flow within the passages. In the embodiment shown, the dimples are substantially square shaped frusto-pyramids, but in other embodiments the dimples may be hemispherical, semi ovoid, frusto-conical, or elongate ridges/troughs. Provision of the protrusions has the effect of providing additional resistance to gas flow, and therefore has the penalty of increasing the gas pressure drop through the fin member, but has an advantage of increasing turbulence in the gas flow, and increasing the surface area of the fin per unit length of the fin member which comes into contact with the gas and therefore enhances heat transfer rate per unit length of fin member.

The second fin member is manufactured from a single elongate substantially smooth sided piece of metal which is initially flat and is formed into the substantially flower shaped cross-sectional form as shown in FIG. 7. The single elongate strip of metal is stamped or pressed to form the plurality of dimples or mounds, and is folded such that a first end and a second end of the metal strip form a first outer connecting wall 713. The fin member is formed such that the outside diameter of the component in an unrestrained state, where the fin member is not inserted into a heat exchange tube is slightly larger than the outside diameter of the component in a constrained state when the component is fitted inside a heat exchange tube. The difference in diameter between the unrestrained and restrained conditions is accommodated by virtue of the two ends of the metal strip forming the first outer circumferential wall part 713 not overlapping each other and being slidable with respect to each other over a circumferential distance less than the circumferential distance of the outer circumferential wall portion.

The fin member may be formed of a resilient metal material, such that once formed it has a resilience and a tendency to expand into its as—formed shape, such that when fitted inside a heat exchange tube and therefore compressed to a slightly smaller diameter circular cylinder, such that the outer circumferential surfaces 713-718 contact and are urged radially outwardly against the inner circular cylindrical surface of a heat exchange tube, thereby ensuring good thermal contact between the fin member and the wall of the heat exchange tube.

In order to fit the fin member into a substantially straight circular cylindrical heat exchange tube, the fin member may be slightly compressed in the circumferential direction, slid into the inside of the heat exchange tube, and released. The resilience of the metal material of the fin member causes the fin to retain itself by friction inside the heat exchange tube.

The second fin assembly may be inserted inside a heat exchange tube and retained inside the heat exchange tube either by friction, or by welding, brazing or soldering similarly as described herein before with reference to the first fin assembly.

Each of the first and second fin assemblies described hereinabove, when manufactured and unrestrained may form a first arc of less than 360°. When the first and/or second fin assembly is inserted into a heat exchange tube, the assembly may be compressed such that it extends over a greater angle of arc than in its uncompressed state. In the installed state the fin will extend over an angle of just under 360°.

The second fin assembly provides a plurality of radially extending elongate passages along a main length of the heat exchange tube, each said passage having a substantially truncated segment shape having an outer arcuate wall and an inner arcuate wall, said elongate passages being provided between the fin member and the inner wall of the heat exchange tube. There is also provided a central gas passage comprising a central circular cylindrical passage and a plurality of radially and circumferentially extending second passages, being substantially segment shaped in cross-section, wherein the second segment shaped portions alternate with the first set of substantially truncated segment shaped passages. The plurality of radially extending first elongate passages are separated from the main central passage by the fin walls. On passing through the second fin member, a single flow of gas is divided into a plurality of parallel gas passages by the fin member, and once passed through the fin member, the gas flow re-converges into a single gas flow.

In each of the first and second fin assemblies described herein, the fin assembly provides a plurality of fin walls which extend inwardly from an inner surface of said inner heat exchange tube towards a main central axis of said heat exchange tube, and which form a plurality of axially extending gas passages which occupy a substantially annular region in a direction perpendicular to said main central axis of said heat exchange tube.

Figure 8:
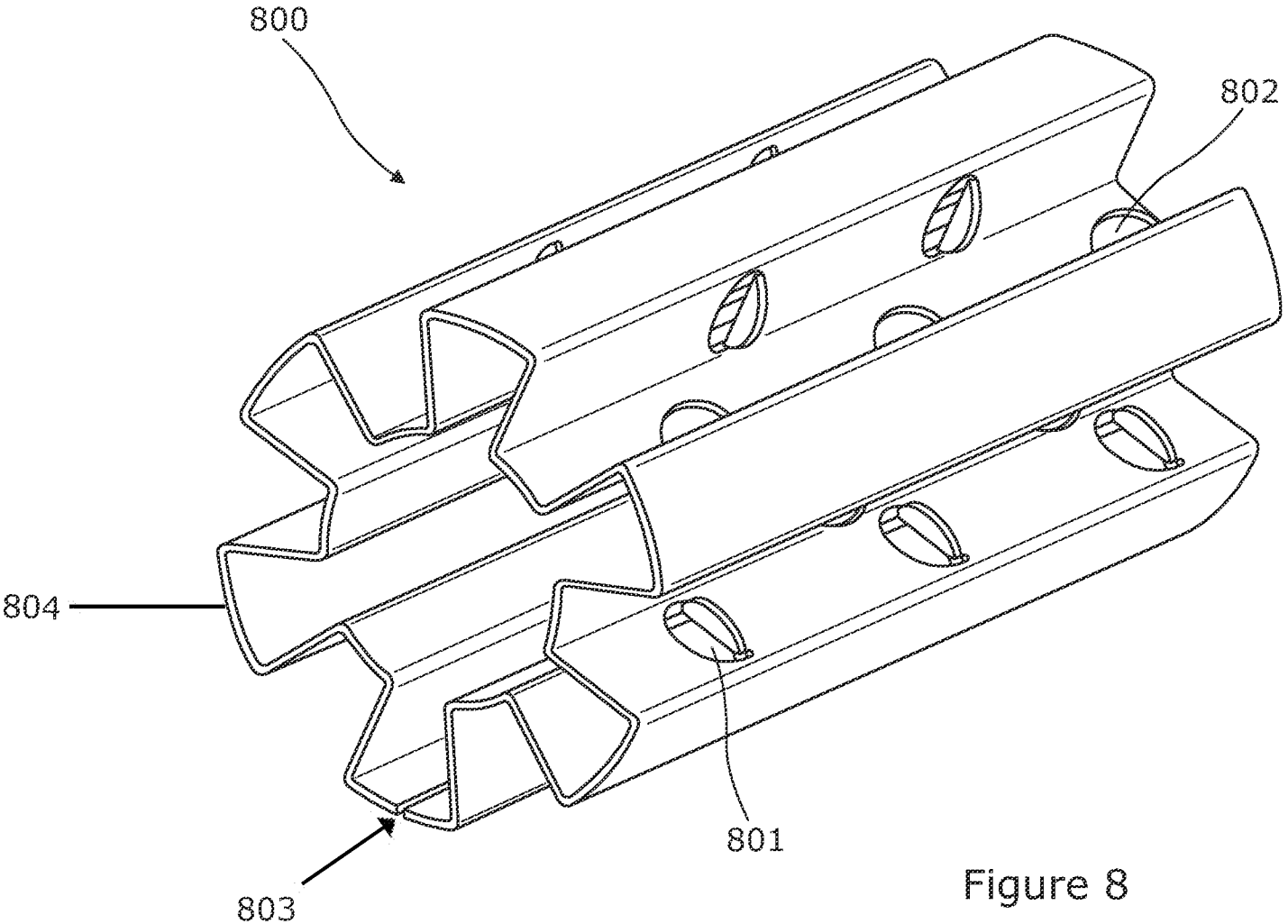
FIG. 8 herein shows a third fin assembly according to a third specific embodiment fin assembly.

Referring to FIG. 8 herein, there is illustrated schematically a third fin assembly 800 also suitable for use in the first embodiment cooler herein. The third fin assembly comprises of the same basic form as FIG. 7. Instead of the dimples being formed into the fin material, the material is pierced on one side, so as to form a plurality of semicircular apertures 801 in the fin walls, and semicircular projections 802 extending into the gas flow path. This opens a path for flow of some gas from an outer gas passage into the inner petal shaped gas passage and from the inner petal shaped gas passage to the adjacent outer gas passages. Fin assembly 800 also includes fin assembly gap 803 and outer fin connecting portions/outer fin connectors 804.

Referring to FIG. 9 herein there is illustrated schematically in view from one end along an axial direction, part of a fin assembly in its installed condition. In this installed condition, a minimum distance/inner gap 901 between any two adjacent fin surfaces is preferably 1.5 mm or greater. Gaps smaller than this tend to cause excessively low gas velocities reducing heat exchange and increasing the likelihood of clogging of exhaust material between the fins.

Referring to FIG. 9 herein there is illustrated schematically in view from one end along an axial direction, part of a fin assembly in its installed condition. In this installed condition, a minimum distance/inner gap 901 between any two adjacent fin surfaces is preferably 1.5 mm or greater. Gaps smaller than this tend to cause excessively low gas velocities reducing heat exchange and increasing the likelihood of clogging of exhaust material between the fins.

A fin assembly gap 902 between the two ends of the formed fin assembly is required. If the two ends touched or over lapped when the fin assembly was in its installed condition, part of the fin assembly may not have the correct contact with the heat exchange tube (unless the contact is a result of friction fit locking clips, as described herein). The gap does not affect heat exchange. Heat conducted from the fin to the heat exchange tube is transferred at or near the interface 903 at the transition between the substantially radially extending fin walls 904, 905 and the arced perimeter portions/outer fin connecting lengths/outer fin connecting portions/outer fin connectors 906. The fin assembly in its as manufactured state tends to have a greater external radius than the internal radius of the heat exchange tube into which it is designed to fit and needs to be compressed slightly in order to fit inside the heat exchange tube. The resilience of the material of which the fin assembly is made cause fin assembly to press against inner surface of the heat exchange tube when fitted therein.

Figure 10A:
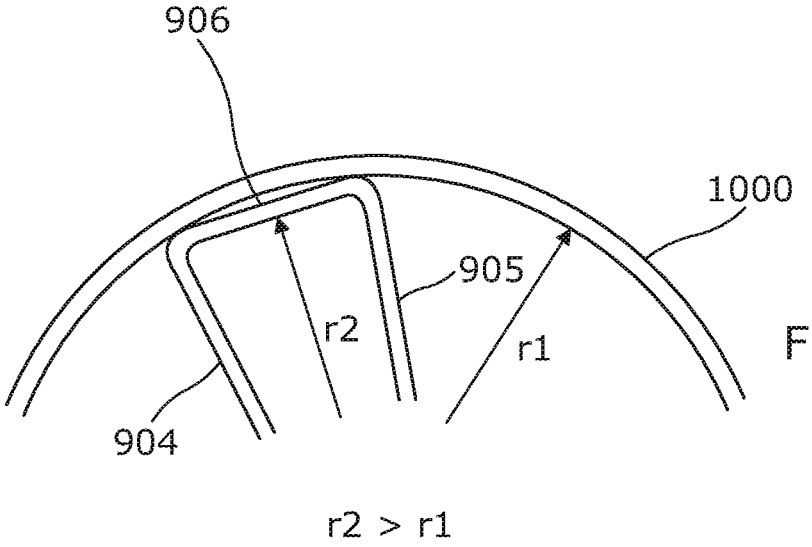
FIG. 10A shows part of the fin assembly of FIG. 9, and part of a heat exchange tube, showing contact points between the fin assembly and the heat exchange tube.

Referring to FIG. 10A herein, a pair of fin walls 904 and 905 and an outer fin connecting length/outer fin connecting portion/outer fin connector 906 are shown in the fin—installed condition inside a heat exchange tube 1000. The fin set contacts with the heat exchange tube 1000 in a region near the bend between the substantially radially extending fin walls and the arc-shaped connecting portions between the fin walls. It can be seen that radius r1 of the heat exchange tube is smaller than the radius r2 of the arced outer surface of the connecting portion/connector 906, as measured from the axial centre of the fin assembly. This ensures that the fin assembly contacts the heat exchange tube as near to the end of the fin walls as possible.

The difference in radii r1 and r2 should not be so great as to cause an excessive gap between the outer fin connecting portion/the outer fin connector 906 and the heat exchange tube. An excessive gap in this region would cause loss of heat exchange.

Figure 10B:
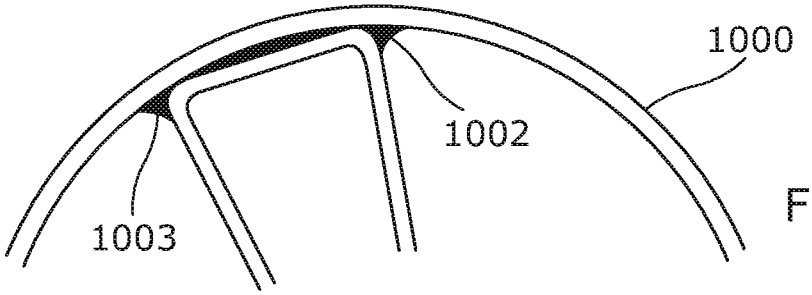
FIG. 10B shows part of the fin assembly and heat exchange tube of FIG. 10A, having brazed connection between the fin assembly and the heat exchange tube, illustrating how a joint having good thermal transfer characteristics is achieved.

Referring to FIG. 10B herein, when the fin is soldered or brazed to the heat exchange tube, a meniscus 1101 and 1102 is formed either side of the contact points between the fin assembly and the inside surface of the inner heat exchange tube. This meniscus ensures the best path for heat conduction. The braze will also fill the gap between the arced outer fin connecting length 906 and the heat exchange tube 1000, as shown in FIG. 11B further improving heat exchange.

Figure 10C:
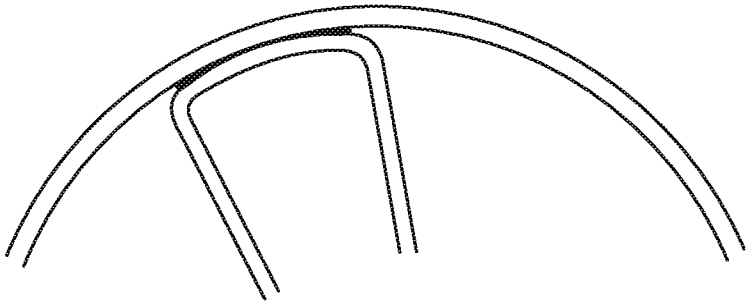
FIG. 10C shows schematically a joint between a fin assembly and the heat exchange tube, which has a non-optimal heat transfer characteristics.

As shown schematically in FIG. 10C herein, if r1 is greater than r2 then the centre of the outer fin connecting portion 906 will contact the heat exchange tube. Even when brazed, the meniscus may not fill the gap between the outer surface of the arced connecting part of the fin assembly and the inner facing surface of the inner tube. This effectively increases the length of the fin wall and reduces heat exchange occurring through conduction between the fin assembly and the inner tube, leading to a less effective heat transfer than where the radially outermost ends of the fin walls contact the inner surface of the heat exchange tube, and are connected by brazing as shown in FIG. 10B herein.

Figure 11:
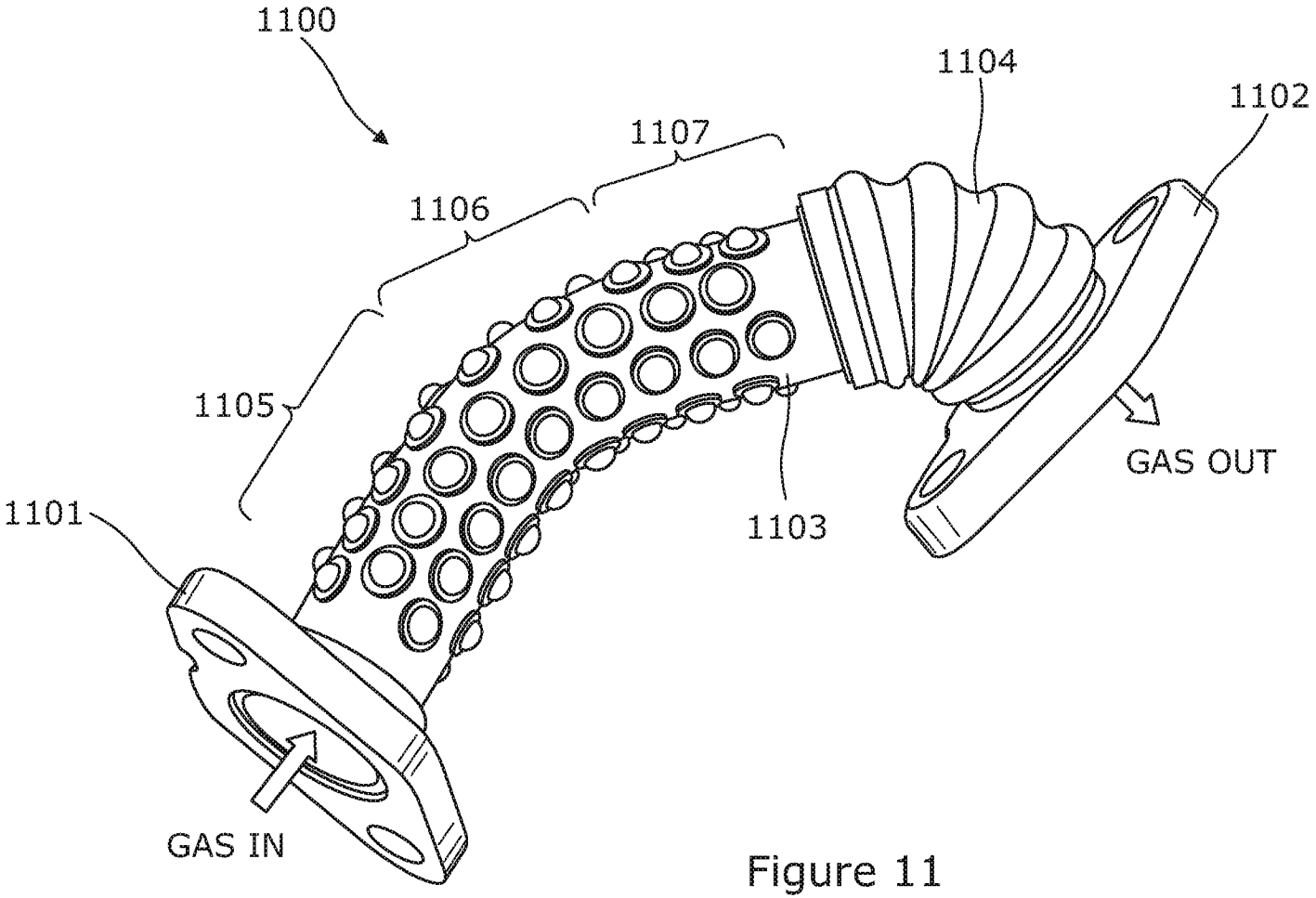
FIG. 11 herein illustrates schematically part of a second cooler device according to a second specific embodiment heat exchanger.

Referring to FIG. 11 herein, there is illustrated schematically part of a second heat exchanger device 1100 showing an internal heat exchange tube 1103 according to a further embodiment heat exchanger. The heat exchanger of FIG. 11 comprises a first flange 1101 at a first end of the heat exchanger; a second flange 1102 at a second end of the heat exchanger; an inner heat exchange tube 1103 extending between the first and second ends; and a corrugated end tube 1104 extending between one end of the inner heat exchange tube 1103 and the second flange 1102. The heat exchanger of FIG. 11 also comprises first and second outer substantially straight jacket sections and a central corrugated outer jacket section surrounding the inner heat exchange tube 1103, similarly as described with respect to the first cooler embodiment of FIGS. 1 to 5 herein. The second heat exchanger also has a coolant inlet tube and a coolant outlet tube. The tube may be fitted with a set of internal fins as described with reference to FIGS. 1 to 8 herein. Preferably, the fins will be attached to a smooth section and the dimples shown in FIG. 11 will be in a non finned area. Preferably, the internal fins occupy straight sections of the inner heat exchange tube. The outer jacket, internal fins, and coolant inlet and outlet tubes are omitted from FIG. 11 in order to show in more detail the structure of the internal heat exchange tube 1103.

The heat exchange tube 1103 comprises a single tubular metal member having a first substantially straight portion 1105; a curved or angled portion 1106; and a second substantially straight portion 1107. An end of the second substantially straight portion 1107 is connected to a first end of the corrugated end tube 1104. The entire heat exchange tube comprising the first and second straight sections 1105, 1107 and the curved section 1106 is in use surrounded by liquid coolant which is encased in a cavity between the heat exchange tube 1103 and first and second outer straight tubular sections and an outer corrugated section.

The tubular wall of the heat exchange tube is formed with a plurality of outwardly projecting mounds or dimples which project into the cavity in which the liquid coolant flows. The projecting dimples or mounds on the outside of the heat exchange tube correspond with respective recesses on the otherwise smooth internal heat exchange tube wall on the inside of the tube. The projections provide a relatively increased surface area for heat transfer between the gas on one side of the surface, and the liquid coolant on the other side of the surface, compared to a straight circular cylindrical tube.

The effect of the dimples on the heat exchange tube was found to cause only a low increase in the turbulence of the exhaust gas. The dimples can be used on the straight portions of the heat exchange only, on the curved portion of the heat exchange tube only, or on both the straight and the curved portion.

Figure 12:
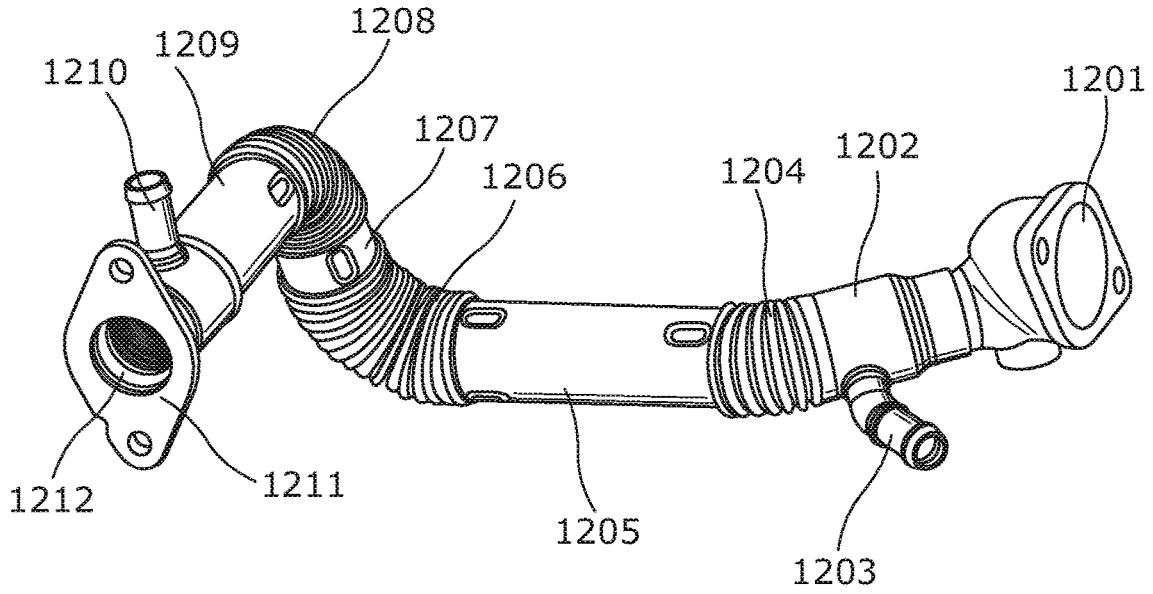
FIG. 12 shows a third cooler device according to a third specific embodiment heat exchanger, having three bends.

Referring to FIG. 12 herein there is shown a third co-axial cooler according to a third embodiment heat exchanger, having three bends and four straights. The cooler consists of a gas inlet boss 1201 a straight section 1202 with a coolant connection tube 1203, a first corrugated section 1204, a second straight section 1205, a second corrugated section 1206, a third straight section 1207 a third corrugated section 1208, a fourth section 1209 with a second coolant connection 1210 and a flange 1211. Inside the cooler is a heat exchange tube 1212 and (not shown in FIG. 12) a number of fins.

Corrugated sections 1204, 1206 and 1208 each have a small straight section either side of a bent section.

The heat exchange tube 1212 has a dimpled section (as illustrated in FIG. 11 herein) in the length inside the first straight section 1202. In this section there are no fins, this reduces heat exchange at the gas inlet and aids the reduction of localized boiling of coolant in the outer jacket surrounding the first straight section. The heat exchange tube 1212 inside the first corrugated section 1204 is also corrugated and has no fin. The heat exchange tube inside second straight section 1205 has a smooth surface and a fin brazed to it over at least part of its length. At both ends of the second straight section 1205, the tube has a single line of dimples. The heat exchange tube 1212 under the corrugated section 1206 is also corrugated and has no fin. The heat exchange tube 1212 inside the straight section 1207 has a dimpled section and no fin. The heat exchange tube 1212 inside the third corrugated section 1208 is also corrugated and has no fin. The heat exchange tube 1212 inside fourth straight section 1209 has a smooth surface and a fin brazed to it over at least part of its length. At the end of the fourth straight section adjacent to the third corrugated section 1208, the heat exchange tube has a single line of dimples. Thus the heat exchange tube is made of sections of smooth tubing with fins attached, a short length of tube either side of the finned area with dimples, straight sections with dimples without fins and a corrugated section without fins.

It is apparent to one skilled in the art that the gas could flow in the opposite direction entering the cooler at the flange 1211. This may be a preferred gas flow regime if there was a concern with boiling at the corrugated bend. The first finned section within the fourth straight section 1209 would have already substantially cooled the gas prior to the bend 1208 in the third corrugated section. All designs will be variations and dependant on the required c application and boundary conditions.

Figure 13:
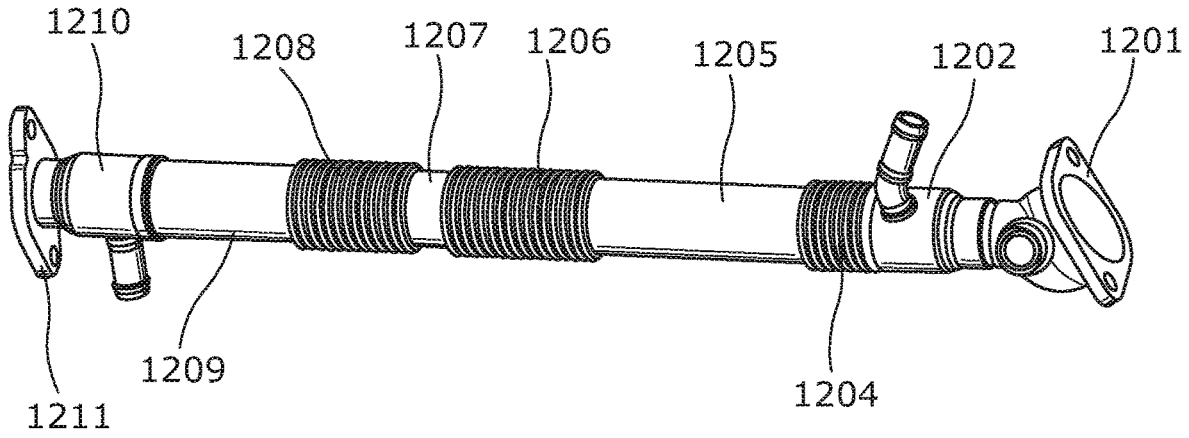
FIG. 13 shows the third cooler of FIG. 12 in its pre-bent condition during a stage of manufacture.

Referring to FIG. 13 herein, the third cooler is shown assembled in its straight condition. Fins are brazed to the heat exchange tube in the second and fourth straight section regions 1205 and 1207. There are dimples on the heat exchange tube in the second, third and fourth straight regions 1205, 1207, 1209. The outer diameter formed by the crest of the dimples is nominally at the same diameter as the internal diameter of the outer tube. Tolerancing is set to enable assembly.

Once assembled the first corrugation at 1204 is bent. This action causes both the outer tube and the inner heat exchange tube to bend together. The assembly is then bent at the second corrugated section 1206 and finally at the third corrugated section 1208. By virtue of the dimples' outer diameter being nominally the same diameter as the inner diameter of the outer tube the heat exchange tube is maintained in a substantially concentric condition during bending.

Figure 14:
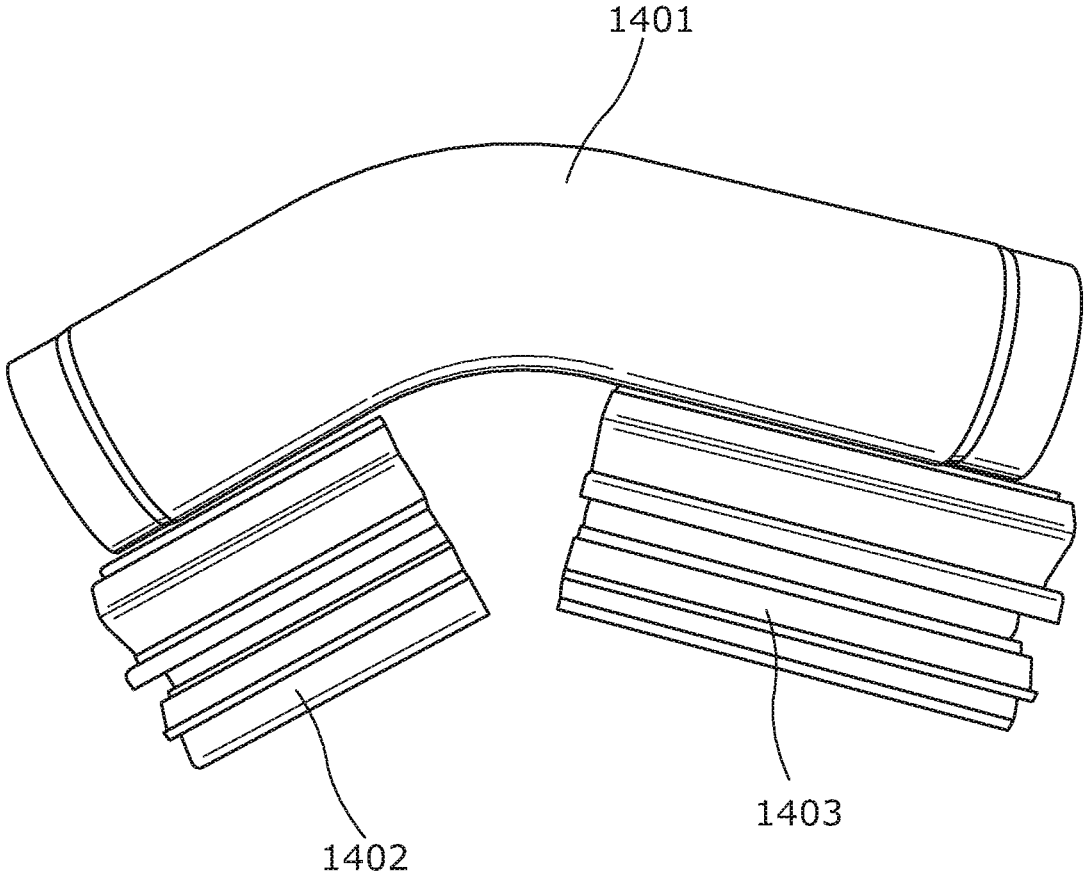
FIG. 14 shows the heat exchange tube of the first cooler with the two fin sets placed next to their straight sections of the heat exchange tube.

Referring to FIG. 14 herein there is shown an inner tube 1401 of the first embodiment heat exchanger tube 1401 and two sets of fins 1402 and 1403 from the heat exchanger shown in FIG. 1.

Figure 15:
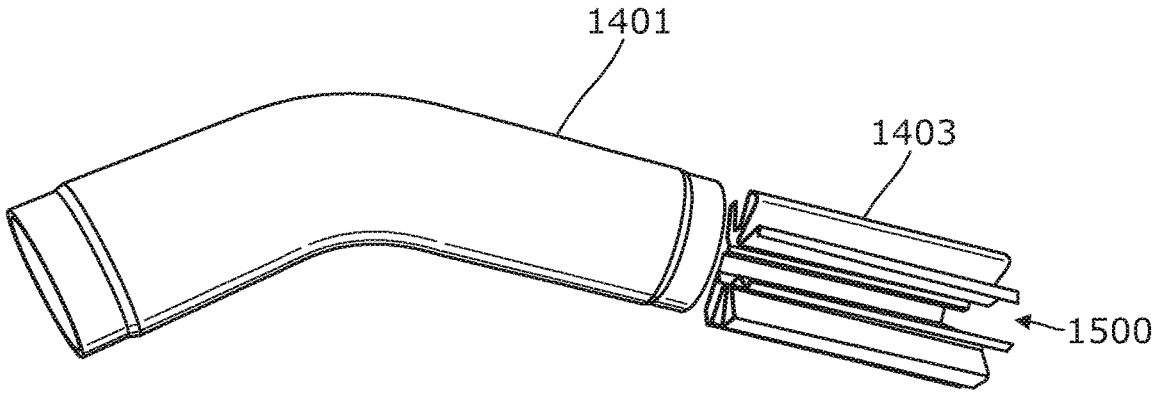
FIG. 15 shows the heat exchange tube for the first cooler with one of the fin sets in its manufactured condition prior to insertion in the heat exchange tube.

Referring to FIG. 15 herein there is shown the heat exchange tube 1401 and one fin set 1403 in its as—manufactured condition. It can be seen that there is a substantial width gap 1500 between the ends of the fin form. The diameter of the fin in this condition is greater than the internal diameter of the heat exchange tube 1401.

Figure 16:
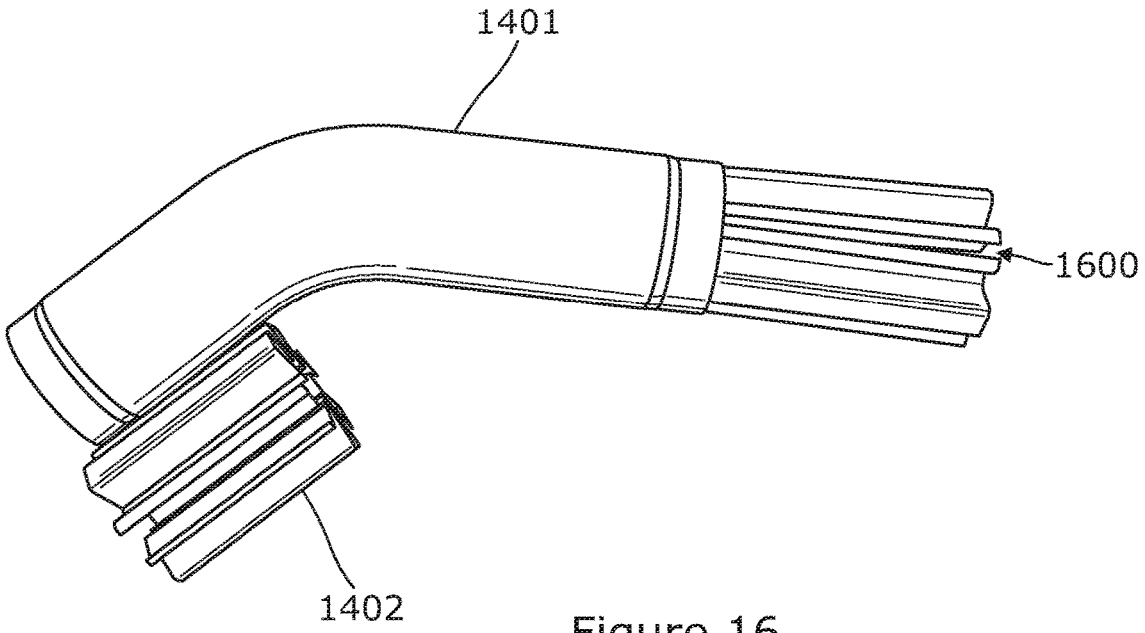
FIG. 16 shows the heat exchange tube for the first cooler with one of the fin sets partially inserted therein.

Referring to FIG. 16 herein there is shown one of the fin sets 1403 partially inserted into the heat exchange tube 1401. The gap 1600 between the ends of the fin form can now been seen to be substantially smaller than the gap 1500 in the fin set's unconstrained state. The fin set 1403 is now compressed and the elasticity of the material tries to open the fin set outwards. This ensures that close contact is maintained between the fin and heat exchange tube.

Fin Materials

In various embodiments, the internal fin members may be constructed of ferritic stainless steel. Ferritic stainless steel has a significantly higher thermal conductivity than 300 series stainless steel and was found to give a reduced gas out temperature of 18° C. lower than the corresponding gas out temperature using equivalent fins made of stainless steel 321. The use of ferretic stainless steel fins compared to using stainless steel 321 reduced the gas out temperature by up to 18° C. under equivalent operating conditions.

The fins may be manufactured from 309, 310 or Inconel.

Undulating Corrugated Fins

In addition to the embodiments described above, other fin geometries may be utilized in the cooler to further improve the rate of heat transfer between the gas and liquid coolant. In general, the fins act as conduits for drawing heat from the center of the gas flow within an inner heat exchange tube to the outer walls of the inner heat exchange tube, which is in contact with a liquid coolant. In some instances, the fin geometry may be adjusted to cause increased turbulence in gas flowing through the passages defined by the fins. This increased turbulence encourages greater heat transfer from the gas to the fins.

Figure 17:
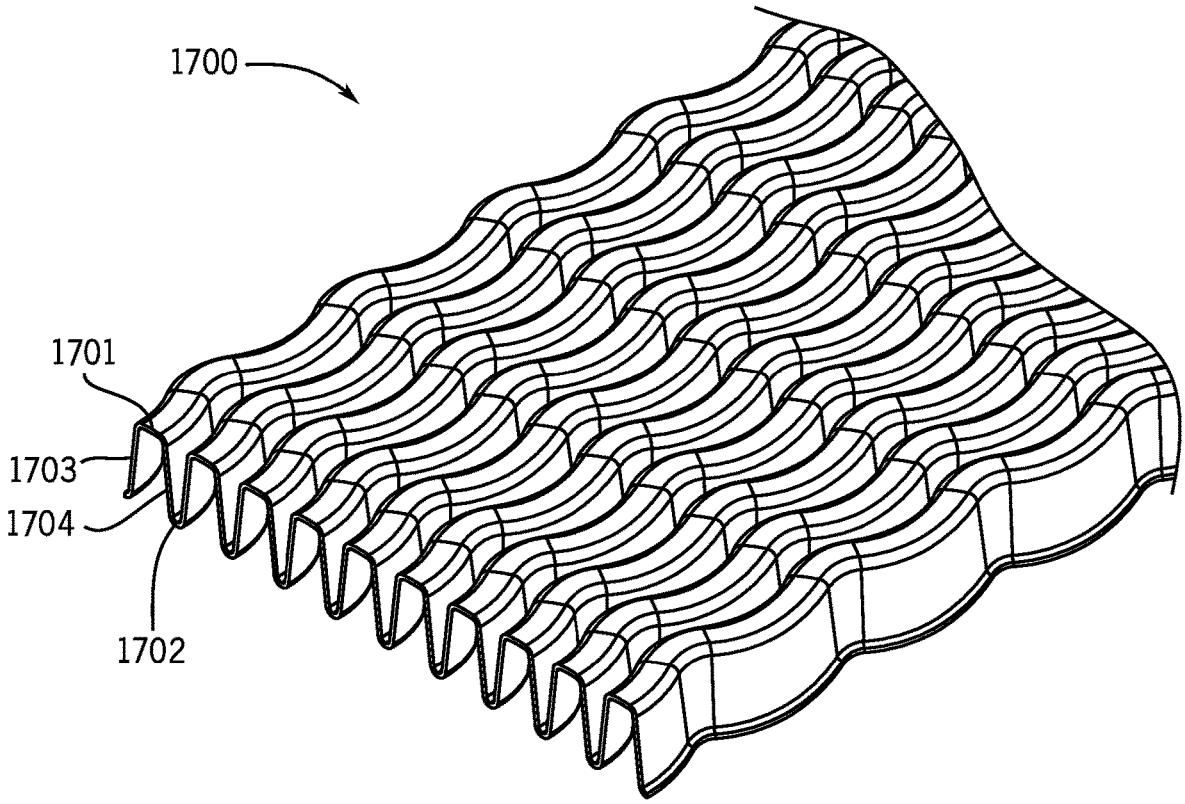
FIG. 17 shows a portion of an undulating corrugated fin sheet in an unrolled state.
Figure 18:
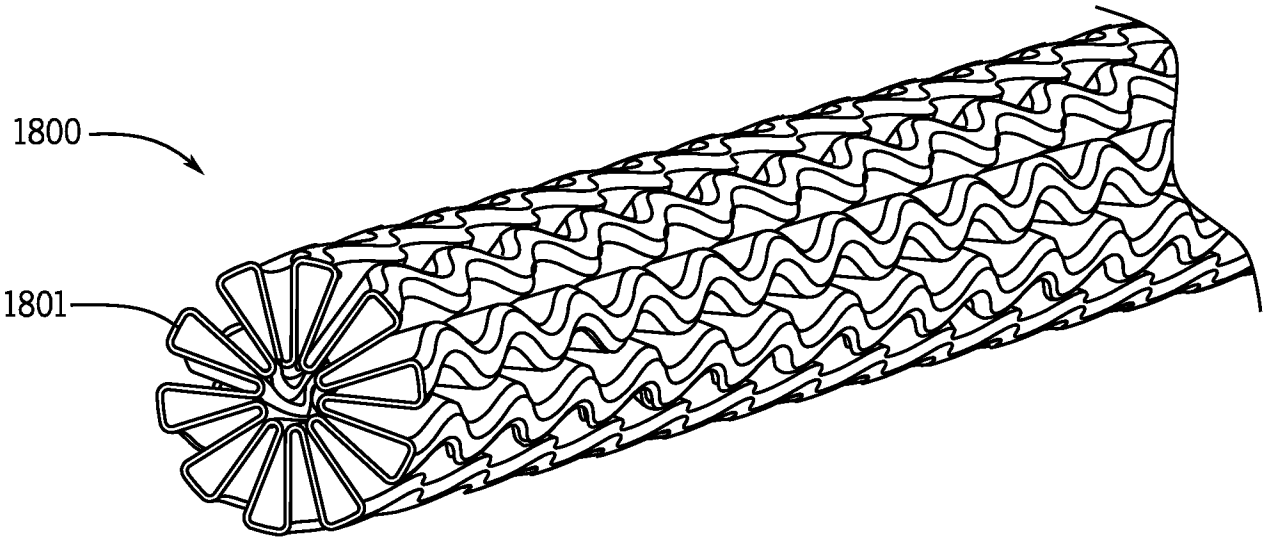
FIG. 18 shows a substantially cylindrical radial undulating corrugated fin assembly.

One example of fin geometry that provides such increased turbulence is illustrated in FIGS. 17 and 18. FIG. 17 depicts a portion of a corrugated undulating fin sheet 1700 in an unrolled state. Similar to other fin geometries shown in FIGS. 1-16, the fins in FIG. 17 includes inwardly extending walls and arced outer connecting walls that collectively form a corrugated shape. The corrugations effectively form longitudinal channels or "fins." The fin sheet 1700 also includes lateral undulations that may perturb gas flowing longitudinally along the channels or fins, introducing turbulence that increases heat exchange from the gas to the fin sheet 1700.

The corrugations of fin sheet 1700 may form outer fin tips (e.g., outer fin tip 1701) and inner fin tips (e.g., inner fin tip 1702) connected to each other via connecting walls (e.g., connecting walls 1703 and 1704). In some embodiments, the outer fin tips may include a straight or arced portion that is substantially larger than the straight or arced portion of the inner fin tips. Such an asymmetrical geometry may provide increased contact between the outer fin tips and an inner surface of an inner heat exchange tube (when rolled in a substantially cylindrical shape, as shown in FIG. 18). In general, an increase in surface area contact between the outer fin tips and an inner surface of an inner heat exchange tube increases the amount of heat transfer between the fins and the inner heat exchange tube.

In addition to increasing gas turbulence and heat transfer, the undulating and other nonlinear fin sheet geometries may also act to absorb thermal expansion of the fins, thereby reducing stresses within the fins, at the interface between the outer fin tips and an inner surface of an inner heat exchange tube, and/or at the interface between the fins and the bulkhead interface (e.g., fins within the finned heat exchange tube 2102 and the head plate 2101). During operation, the inner fin tips can become very hot—in some instances, at or near the temperature of the gas flowing therethrough—resulting in substantial thermal expansion. The undulations in the fin sheet 1700 may provide room for thermal expansion horizontally, or circumferentially when rolled into a substantially cylindrical fin assembly (e.g., as shown in FIG. 18). This may reduce stresses resulting from thermal expansion pushing in the radially outward direction and/or in the coaxial direction (i.e., at the distal and/or proximal ends of the fin assembly).

The undulating fin sheet 1700 may be initially formed from a single strip of initially flat metal, having a smooth surface on both sides. Then, the strip may be pressed or otherwise formed into the shape illustrated in FIG. 17. The undulating fin sheet 1700 may be inserted into heat exchange cavities, including cavities that have cross-sectional shapes that are oval, circular or substantially rectangular. In some embodiments, the undulating fin sheet 1700 is rolled into an undulating radial fin assembly, such as fin assembly 1800 illustrated in FIG. 18.

FIG. 18 depicts substantially cylindrical undulating fin assembly 1800. Like other fin assemblies described herein, fin assembly 1800 may be inserted or fitted within an inner heat exchange tube, such that the arced outer connecting walls (such as outer connecting wall 1801) is at least partially in contact with the inner wall of the inner heat exchange tube.

During operation, hot gas flows from an inlet end of a heat exchange tube to an outlet end of the heat exchange tube. Gas may enter through the radially central region—including the region defined by the radially inwardly facing surfaces of the fin assembly—or through one of the channels formed from the radially outwardly facing surfaces of the fin assembly. As gas flows through one of these channels, it may collide with the walls of these channels, facilitating a transfer of heat from the gas to the fin walls. The heat from the fin walls may be drawn outwardly toward an inner heat exchange tube, which tube may be cooled using a liquid coolant.

Although FIG. 18 depicts an axially sinusoidal or wave-like shape, other axial geometries that facilitate turbulence and/or exchange of heat from the gas to the fin walls may be used. For example, other geometries may have undulations that have a different frequency or amplitude than depicted in FIG. 18. Other non-sinusoidal geometries may be used, such as square waves, triangle waves, or sawtooth waves, among other geometries. Furthermore, such other geometries may also be non-periodic, asymmetrical, or any other shape.

Figure 19A:
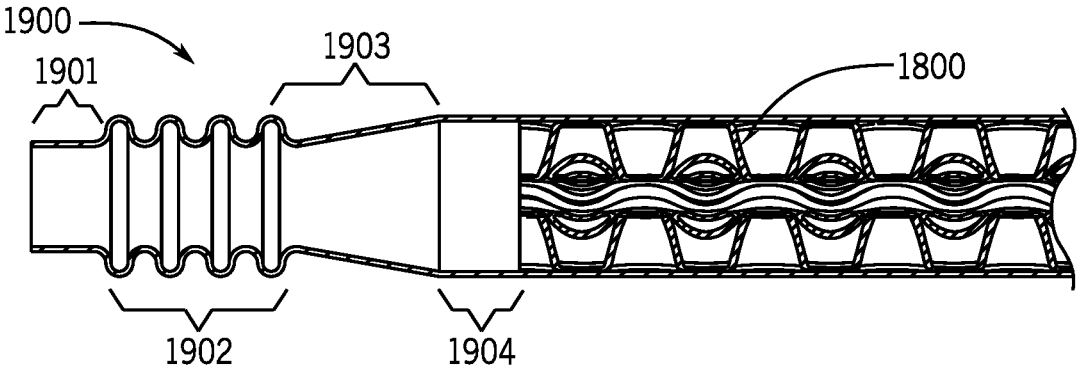
FIG. 19A shows an elevated cross-sectional side view, of a portion of a cooler with a radial undulating corrugated fin assembly.
Figure 19B:
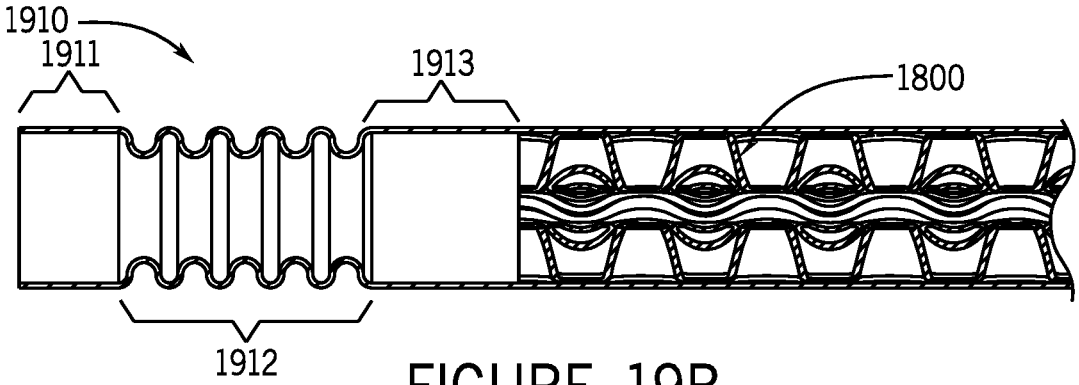
FIG. 19B shows another elevated cross-sectional side view, of a portion of a cooler with a radial undulating corrugated fin assembly.
Figure 19C:
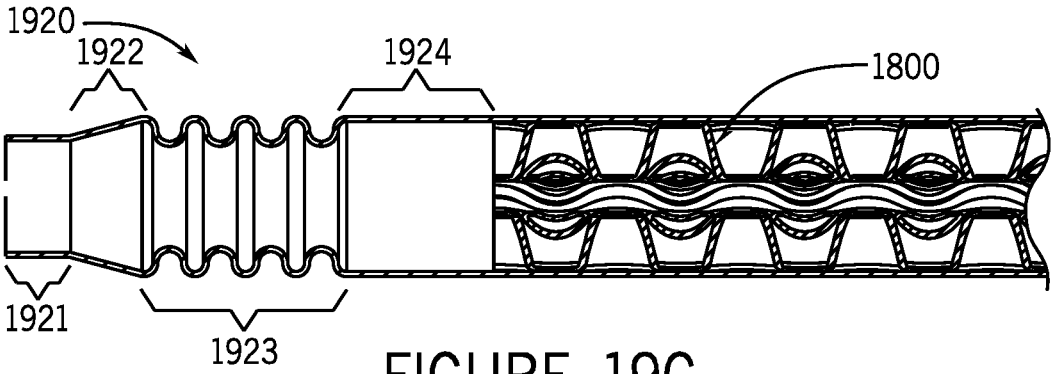
FIG. 19C shows yet another elevated cross-sectional side view, of a portion of a cooler with a radial undulating corrugated fin assembly.

FIGS. 19A-19C show three elevated cross-sectional side views of portions of the finned heat exchange tubes. In each cooler shown, differently shaped connecting portions may be used, depending on the particular embodiment. For instance, an inlet or outlet region may be shaped to fit or abut another component within an engine. Additionally, some regions may adjust the coaxial diameter axially (i.e., a reducer), which may increase or decrease gas velocity flowing through those regions. It should be understood that the present disclosure is not limited to the examples specifically shown in FIGS. 19A-19C.

Referring to FIG. 19A, cooler 1900 includes first substantially straight portion 1901, flexible corrugated central section 1902, angled section 1903, second substantially straight portion 1904, and cooling tube section 1906, which contains undulating fin assembly 1800. As shown, first substantially straight portion 1901 and flexible corrugated central section 1902 have approximately the same diameter, excluding the diameter of the tubular bellows corrugations. Angled section 1903 increases the diameter of the annular cavity between flexible corrugated central section 1902 and second substantially straight portion 1904. Second substantially straight portion 1904 is coupled to cooling tube section 1906, which contains undulating fin assembly 1800. In this arrangement, gas may flow from right to left or left to right, depending on the particular implementation.

Referring to FIG. 19B, cooler 1910 includes first substantially straight portion 1911, flexible corrugated central section 1912, second substantially straight portion 1913, and cooling tube section 1916, which contains undulating fin assembly 1800. As shown, first substantially straight portion 1911, flexible corrugated central section 1912, and second substantially straight portion 1913 have approximately the same diameter, including the diameter of the tubular bellows corrugations. Second substantially straight portion 1913 is coupled to cooling tube section 1916, which contains undulating fin assembly 1800. In this arrangement, gas may flow from right to left or left to right, depending on the particular implementation.

Referring to FIG. 19C, cooler 1920 includes first substantially straight portion 1921, angled section 1922, flexible corrugated central section 1923, second substantially straight portion 1924, and cooling tube section 1926, which contains undulating fin assembly 1800. As shown, angle section 1922 increases the diameter of the annular cavity between first substantially straight portion 1921 and flexible corrugated central section 1923, including the diameter of the tubular bellows corrugations. Flexible corrugated central section 1923 is coupled to second substantially straight portion 1924, which is itself coupled to cooling tube section 1926, which contains undulating fin assembly 1800. In this arrangement, gas may flow from right to left or left to right, depending on the particular implementation.

FIGS. 19A-19C depict different cooler configurations, each having respective advantages. For instance, the tubular bellows portion of a cooler may be include "bellows out" corrugations (e.g., tubular bellows 1912 and 1923) or "bellows in" corrugations (e.g., tubular bellows 1902). From a manufacturing standpoint, it may be easier to produce "bellows out" corrugations compared to producing "bellows in" corrugations. However, "bellows out" corrugations may provide less volume for one or more finned heat exchange tubes to fit into compared to "bellows in" corrugations. Thus, depending on a desired amount of cooling and manufacturing cost or time constraints, heat exchangers of the present application may use "bellows out" corrugations, "bellows in" corrugations, or some combination thereof.

Multiple Fin Lengths

Figure 20:
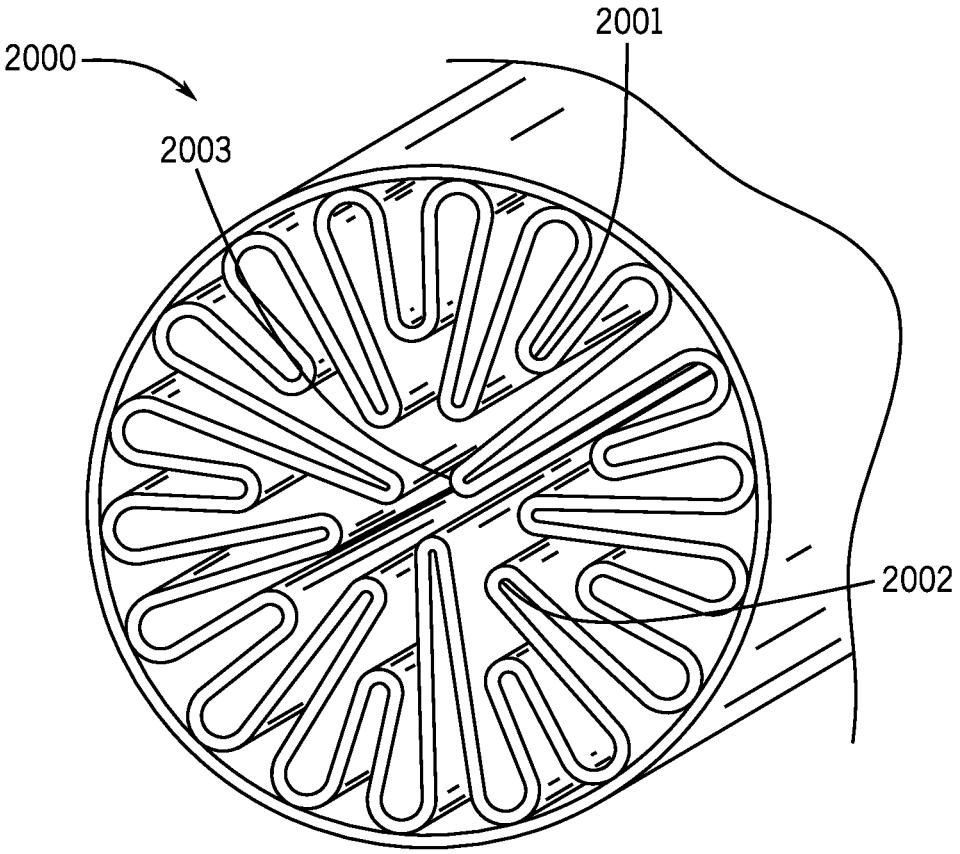
FIG. 20 shows a perspective view of a fin assembly with varying fin heights.

In some embodiments, a fin assembly may include fins having two or more different lengths. FIG. 20 shows a perspective view of a portion of a fin assembly 2000 with three different fin lengths. In embodiments where all of the fins have a uniform length, the gap between the fins may become narrow, leading to increasing drag on gases passing near those parts of the fin. This may result in lower gas velocities and decreased heat exchange between the gas and the fin walls. One way of avoiding the issues caused by narrow channels, while maintaining a large number of fins, is to vary the lengths of successive fins. Fin assembly 2000 varies the lengths of successive fins by utilizing three different fin lengths—repeating a series of short fins (e.g., fin 2001), medium fins (e.g., fin 2002), and long fins (e.g., fin 2003)—in order to fit many fin structures within fin assembly 2000, without creating an overly narrow gap between the fins.

While FIG. 20 depicts a fin assembly 2000 having three different fin lengths, it should be understood that any number of fin lengths may be used without departing from the scope of the present application. Successive fins in other fin assemblies may also not follow a symmetrical or periodic fin length pattern. The number of fins and the number of fin lengths used in a particular fin assembly may depend on the fin material, thickness, the diameter of the inner heat exchange tube, and a desired amount of cooling, among other possible factors.

Arrayed Fin Assembly

In some embodiments, a cooler may include a region formed from multiple heat exchange tubes—such as fin assembly 2000 or other fin assemblies described herein—arranged substantially in parallel to each other in the coaxial direction. Each of these heat exchangers may include an inner heat exchange tube surrounding a fin assembly. Collectively, the plurality of heat exchangers may be surrounded by a tubular outer body, forming a cavity between the inner walls of the tubular outer body and the outer walls of the inner heat exchange tubes of the heat exchangers. Liquid coolant may flow through this cavity, drawing heat away from gas passing through the heat exchangers. Hot gas provided to the heat exchanger array may pass through the heat exchangers, and furthermore may pass through channels within those heat exchangers defined by the fin assemblies therein. In this manner, greater heat transfer may be achieved over non-arrayed fin assemblies or coolers.

As described herein, each heat exchanger within an array may be referred to as a "coaxial cooler," and a plurality of coaxial coolers may be referred to as a "bulkhead assembly."

Figure 21:
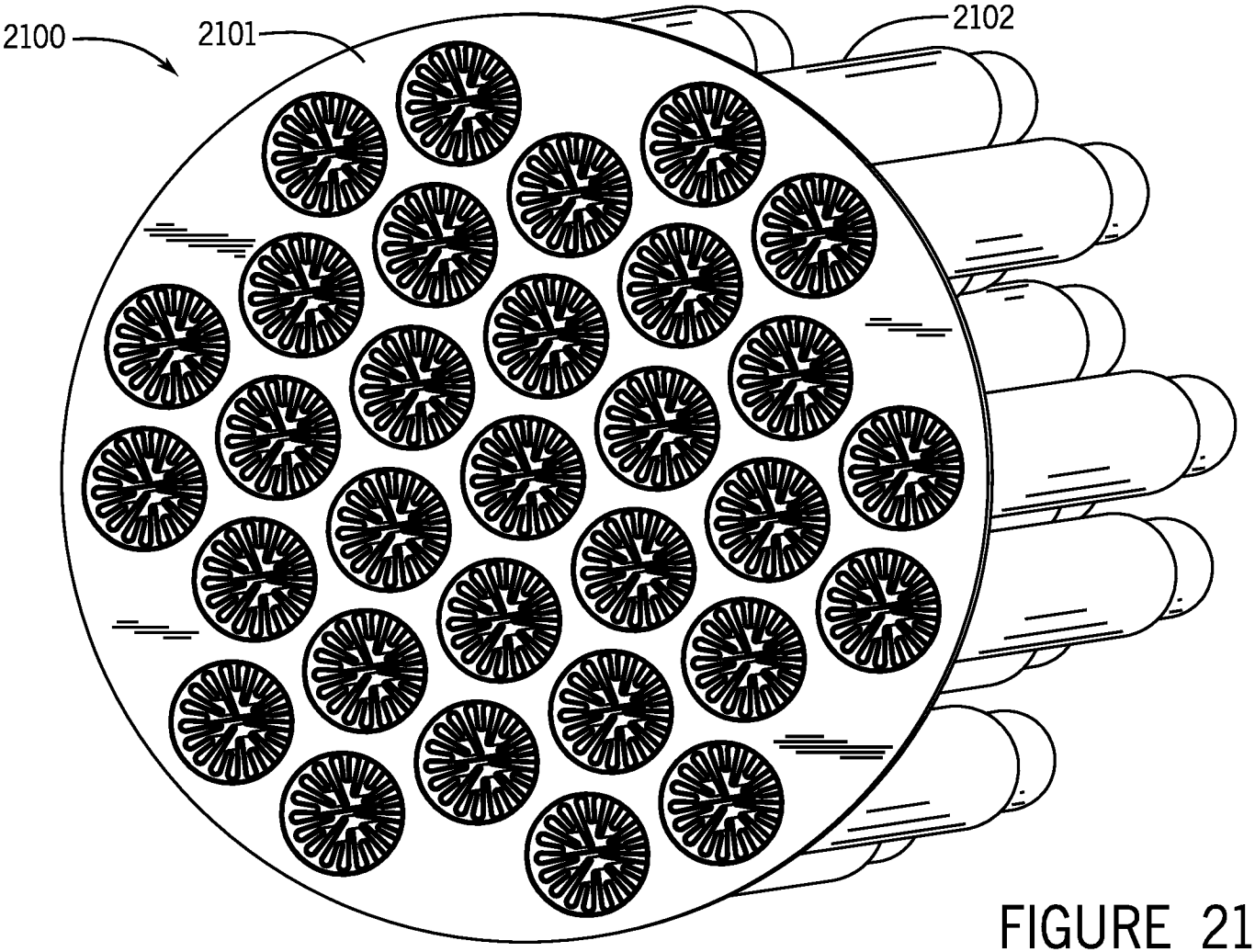
FIG. 21 shows a plurality of round radial fin tubes in a bulkhead assembly.

FIG. 21 illustrates a gas domain portion of bulkhead assembly 2100, which includes a plurality of finned heat exchange tubes (such as finned heat exchange tube 2102) or round radial fin tubes arranged substantially parallel to each other. The inlets of the coaxial coolers may be coupled to a head plate 2101, which may be coupled with other sections of a cooler that act as a channel for inlet or outlet gas. Although not illustrated in FIG. 21, bulkhead assembly 2100 may include a tubular outer wall surrounding the plurality of coaxial coolers. Such a tubular outer wall may have a diameter approximately the same as that of the head plate 2101. The tubular outer body may include inlet and outlet sections that allow liquid coolant to flow between and among the outer surfaces of the plurality of coaxial coolers, thereby cooling the gas flowing through those coolers.

Although FIG. 21 illustrates coaxial coolers having fin assemblies with varying fin heights (e.g., fin assembly 2000 shown in FIG. 20), other bulkhead assemblies may use coaxial coolers with other fin types described herein. It should be understood that the varying fin heights shown in FIG. 21 is merely an example, and that the present application includes bulkhead coolers with various types of fin assemblies.

Slotted Fin Assembly

During operation, different portions of a fin assembly used for heat exchange may have significant differences in temperature. For example, the radially outward walls, which are in contact with the inner heat exchange tube (where coolant flows) may be substantially cooler than it's the radially inward walls, located deeper inside and farther away from the inner heat exchange tube. In some instances, this temperature gradient may not be large enough to produce detrimental effects. However, in applications where the temperature gradient is large (e.g., a 90° C. liquid coolant and a 1000° C. post-combustion gas), the large temperature differential spanning across the height of the fin (i.e., the radial direction) may create additional stress. Specifically, since heat causes materials to expand, the large temperature differential may cause portions of fins or of the fin assembly to experience substantially different amounts of thermal expansion. As one example, the hotter "tip" (radially inward section) of the fin may expand considerably compared to the colder "tip" (radially outward section, closer to the inner heat exchange tube).

This differential expansion may result in substantial stress levels in the fin assembly, particularly at or near the meeting point of the fin with the inner heat exchange tube. If the thermal expansion causes the fin to push on the inner heat exchange tube with enough force, the inner heat exchange tube may crack or fracture, providing a leak path through which the gas and liquid coolant may mix. This type of failure can be significant, especially in systems where the coolant recirculates cooled gas directly into combustion chambers of an engine.

To reduce the mechanical stress applied by the fins to the inner heat exchange tube due to differential thermal expansion, decoupling slots may be provided along the fin height to provide for coaxial, rather than radial, thermal expansion of the fins. The slots may be gaps, spanning both radially along the fin height, as well as coaxially along the fin assembly length. As the radially inward hot fin tip expands, the slots provide room for thermal growth coaxially to reduce the amount of fin stress applied radially toward the inner heat exchange tube.

Figure 22A:
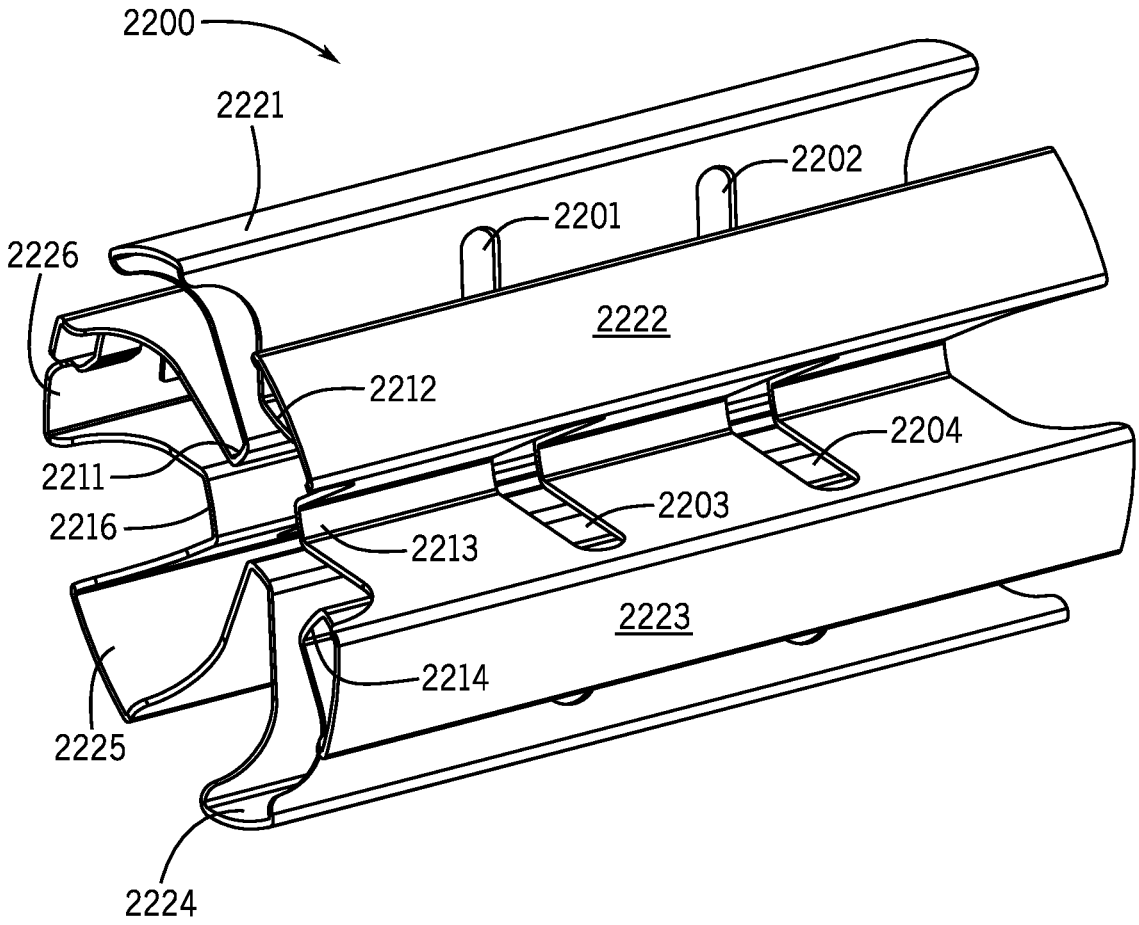
FIG. 22A illustrates an example fin assembly with decoupling slots having uniform width.

FIG. 22A illustrates an example fin assembly 2200 with decoupling slots having uniform width. As shown, slots 2201-2204 extend radially outward from the inner fin tips 2211-2215 (i.e., the radially innermost section of the fin). In FIG. 22A, decoupling slots 2201-2204 are of uniform width in the coaxial direction. Additionally, the proximal and distal ends of fin assembly 2200 do not terminate at the same length; rather, the radially outward sections of the proximal and distal ends of the fin assembly 2200 are longer than the radially inward sections of the proximal and distal ends of the fin assembly 2200. By introducing slots 2201-2204, one section of a hotter part of the fin assembly 2200 may expand coaxially, rather than radially, thereby accommodating thermal expansion and reducing the mechanical stress applied to inner heat exchange tubes or other fluid separation surfaces.

Figure 22B:
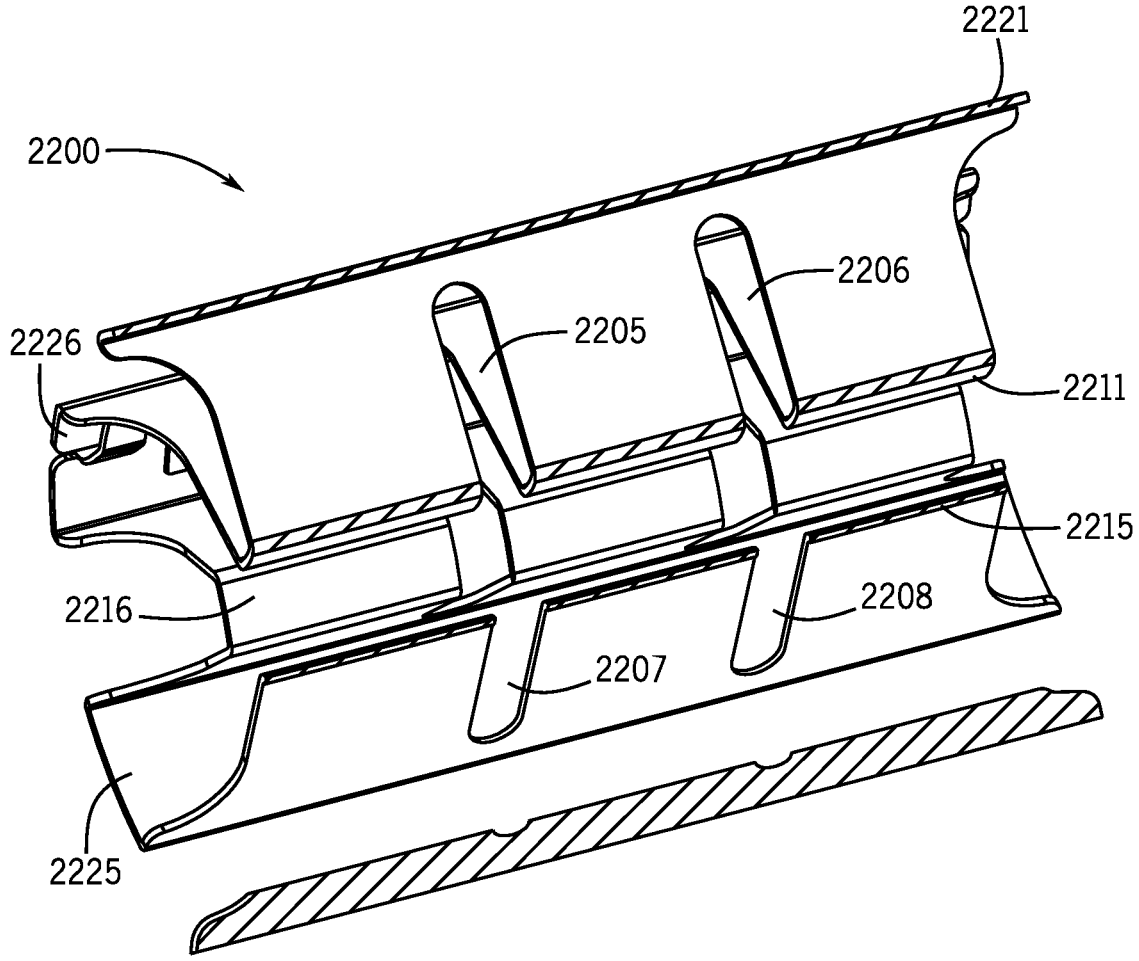
FIG. 22B illustrates a cutaway perspective view of the fin assembly of FIG. 22A with uniform width decoupling slots.

FIG. 22B illustrates a cutaway perspective view of the fin assembly 2200 with uniform width decoupling slots. As shown in the cutaway view, slots 2205 and 2206 may begin at the radially inward fin tip 2211 and extend radially outward toward the outer fin tips 2221 and 2226. Likewise, slots 2207 and 2208 may begin at the radially inward fin tip 2215 and extend radially outward toward outer fin tips 2225 and 2226. Note that the slots may not extend to the entire radial length of the fins.

In some implementations, the minimum coaxial width of slots 2201-2204 may be 0.2 millimeters. However, it should be understood that various slot widths may be used to effect different levels of cooling and/or account for different amounts of thermal expansion, without departing from the scope of the present disclosure.

Figure 23A:
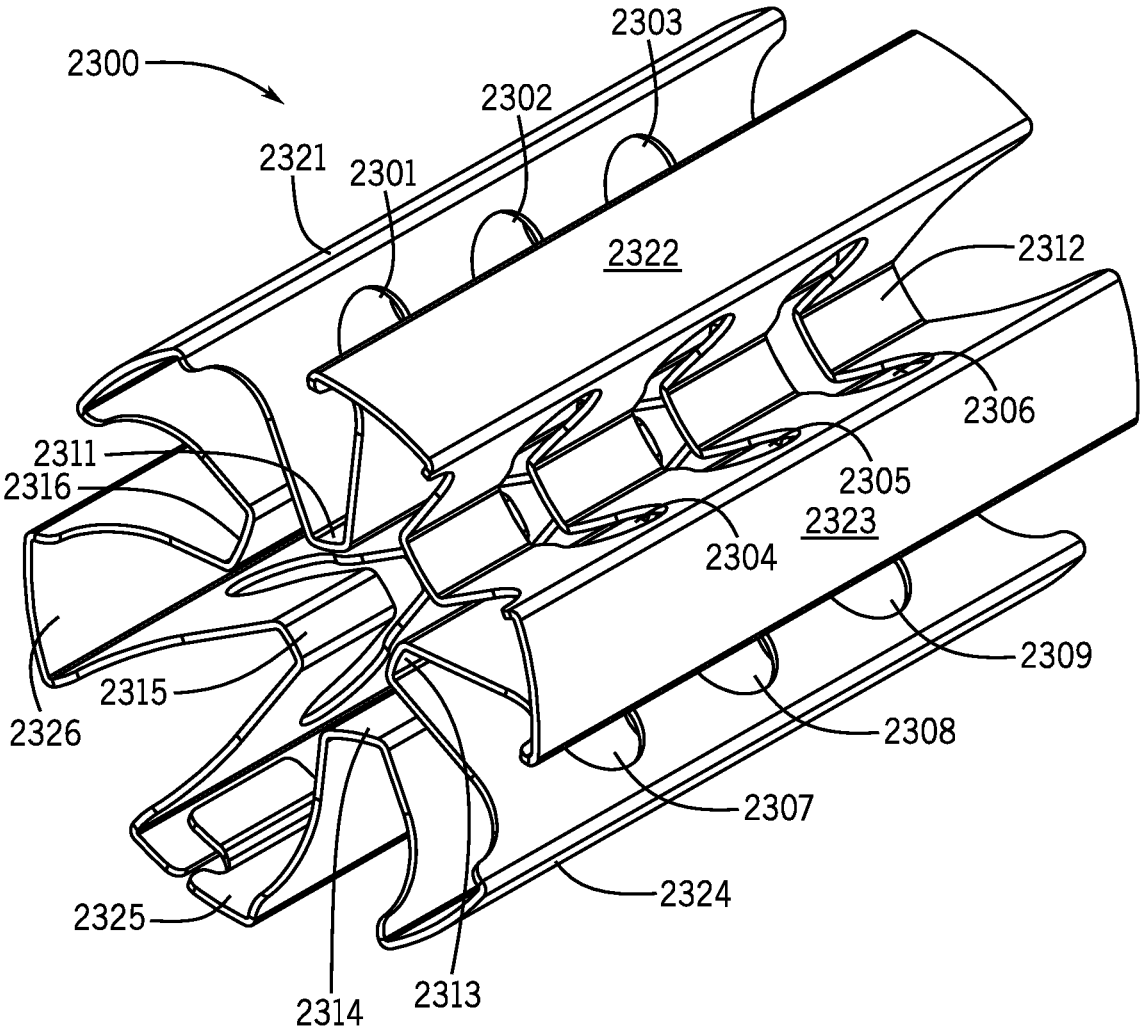
FIG. 23A illustrates an example fin assembly with decoupling slots 2301-2309 having non-uniform width.

FIG. 23A illustrates an example fin assembly 2300 with decoupling slots 2301-2309 having non-uniform width. Decoupling slots 2301-2309 may be of non-uniform width along the radial length of the fins in the coaxial direction. In FIG. 23A, slots 2301-2309 are of a first coaxial width at the radially inward fin tips. Moving radially outward, the coaxial width of the slots widens, then narrows to form a shape similar to a segment of a circle. Other slots may take the shape of an omega, an ellipse, or any other geometry having non-uniform coaxial width in the radial direction. Such slot geometries may further reduce the mechanical stress applied to an inner heat exchange tube due to thermal expansion of the fin assembly.

Figure 23B:
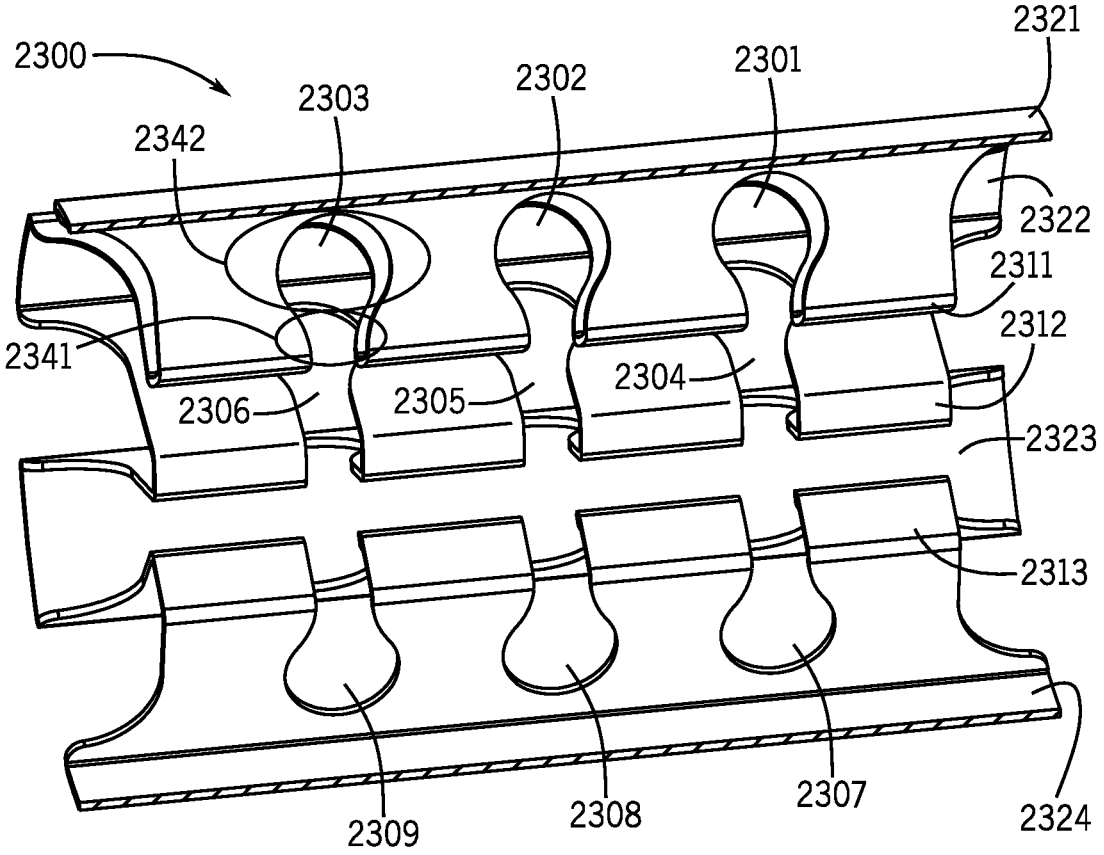
FIG. 23B illustrates a cutaway perspective view of the fin assembly of FIG. 23A with non-uniform width decoupling slots.

FIG. 23B illustrates a cutaway perspective view of the fin assembly 2300 with non-uniform width decoupling slots 2301-2309. As shown in the cutaway view, slots 2301-2303 may begin at the radially inward fin tip 2311 and extend radially outward toward outer fin tips 2321 and 2322. Likewise, slots 2304-2306 may begin at radially inward fin tip 2312 and extend radially outward toward outer fin tips 2322 and 2323. Further, slots 2307-2309 may begin at radially inward fin tip 2313 and extend radially outward toward outer fin tips 2323 and 2324. The non-uniform width may be embodied as a straight slot portion (e.g., straight slot portion 2341) near the radially inward fin tips (e.g., radially inward fin tip 2311) and a circular segment portion (e.g., circular segment portion 2342) near the radially outward fin tips (e.g., radially outward fin tips 2321 and 2322). Note that slots 2301-2309 may not extend to the entire radial length of the fins.

The particular dimensions of non-uniform slots may be adjusted to suit a desired amount of cooling, the expected heat differential between the gas and liquid coolant, and the size and strength of the inner heat exchange tube, among other factors. If the width of the slot becomes too large, the amount of material between slots may become too narrow, and the amount of heat transfer effected by the fin assembly may diminish. On the other hand, if the width of the slot is too narrow, thermal expansion may lead to high mechanical stress and cracking of the inner heat exchange tube. Thus, the particular geometry, dimensions, number, and placements of the slots may depend upon the specific implementation or system in which the cooler is used.

Furthermore, as shown in FIGS. 22A and 23A, the distal and proximal ends of a fin assembly may include cutaways of material in the shape of partial slots, such that the coaxial length of the fin assembly at the radially outward fin tips (where there is no cutaway or partial slot) is greater than the coaxial length of the fin assembly at the radially inward tips (where there is a cutaway or partial slot). Such partial slots may provide room for coaxial thermal expansion at the distal and proximal ends of a fin assembly.

The ratio between the width of material between slots and the widest part of two slots (i.e., the slot "pitch") may vary among different implementations. In some embodiments, the slot pitch may be greater than or equal to 0.25; in other words, successive slots may be separated by at least four times the width of the slots.

Effect of Relative Flow Direction

The embodiment coolers herein can be connected in circuit so that the gas flow and liquid coolant flow can be changed so that the gas coolant are in contra flow (in the opposite direction to each other), or in parallel flow (in the same direction as each other). Computer modelling tests found that by connecting the gas flow and liquid coolant flow in parallel a significant reduction in the boiling index could be achieved, without any significant difference in rate of heat exchange. Therefore, in some applications, connection of the gas flow and liquid coolant flow in parallel may be preferred.

Locking Clips

As described above, a fin assembly may be formed from a single strip or sheet of initially flat metal. The sheet may then be pressed and formed into "fins," and then rolled into a radial fin assembly. In some embodiments, the two outer edges of the sheet touch or are in close proximity to each other once the sheet is rolled into the radial fin assembly (e.g., as shown in FIG. 6, where a gap is present in the very middle of arced outer connecting wall 613). This gap may accommodate manufacturing tolerances, allowing the fin assembly to be squeezed and fit into inner heat exchange tubes of slightly different dimensions.

In some embodiments, the partially open fin gap may include "locking clips" which mechanically couple the two outer ends of the fin sheet and hold together the radial fin assembly. FIG. 24 illustrates an example set of locking clips 2400. The set of locking clips 2400 may be formed from two opposite ends of a corrugated fin sheet that is rolled or otherwise formed into a substantially cylindrical shape, such that opposite ends of the sheet meet near the same circumferential location. The set of locking clips 2400 may include a first end 2410 and a second end 2420 that collectively form, in some embodiments, a radially outward fin tip 2401.

In the example set of locking clips 2400 depicted in FIG. 24, first end 2410 includes a tab 2411 (extending circumferentially from first end 2410) that partially overlaps a portion of second end 2420, and is disposed between tabs 2421 and 2422. Tab 2411 is operably configured to engage with the partially overlapping portion of second end 2420 in an interference or friction fit. Likewise, tabs 2421 and 2422 extend circumferentially from second end 2420, both of which partially overlap respective portions of first end 2410. Tabs 2421 and 2422 are also operably configured to engage with partially overlapping portions of first end 2410 in an interference or friction fit. Collectively, the locking clips may serve to mechanically secure a fin assembly in a substantially cylindrical shape.

As shown in FIG. 24, successive locking clips may alternate, such that successive tabs are formed from opposite sides of the fin. Note that "raised" protrusions described above may refer to a change in length in the radially inward or radially outward direction. Collectively, the locking clips 2400 form a portion of a radially outward fin wall 2401 (i.e., an arced outer fin in contact with or close to the inner heat exchange tube).

In non-locking clip embodiments, the size of the gap between the two ends of the fin sheet may depend on the exact size of the inner heat exchange tube, which constrains the radial fin assembly from unrolling. In locking clip embodiments, the locking clips may act as mechanically secure fasteners that maintain a consistent gap dimension between the ends of the sheet that form the gap. A consistent gap width may be beneficial for certain manufacturing processes, such as brazing.

Retention Features

When assembling a cooler prior to brazing, it may be desired to have cooler components that can be assembled without moving relative to each other. Some interfaces between components within a cooler may be tack welded, while other joints may be press fit or mechanically secured via retention.

If a component is fitted into a cooler by retention, the retention method generally needs to be accurate enough to retain the component in its correct position. In the present application, an outer body tube or outer shell may be retained between two reducer castings. The outer body tube or shell may need to fit closely to the retaining features in order to maintain its proper position. In some instances, a square retention feature may act as a backstop against which the outer body tube may abut; however, a square retention feature is poor for braze paste or welding, as the paste may not flow in a direction that forms a secure weld or joint.

Some embodiments herein may include an angled retention feature that provides an accurate alignment for brazing or welding of adjacent components, such as a tubular bellows section and fin assembly. In some embodiments, the angled retention feature may include a chamfered or angled portion between 15 and 75 degrees with respect to the surface of the tubular outer body.

FIG. 25 depicts a portion of a cooler 2500 where tubular bellows section 2501 is retention fit adjacent to coaxial cooler section 2502. Coaxial cooler section 2502 includes tubular outer body 2503 and fin assembly 2504. As shown, tubular bellows section 2501 includes lip 2505 that slides over a portion of tubular outer body 2503. The end of lip 2505 may abut or be in close proximity to angled retention feature 2506. In this arrangement, braze paste or soldering material may be applied to angled retention feature 2506 which, when melted, may flow toward the joint formed between angled retention feature 2506 and lip 2505. Angled retention feature 2506 allows the braze paste to be applied in an area that is not directly above the joint, while also improving the flow of the braze paste towards the joint during brazing.

Other Variations

In various embodiments disclosed herein, and variations thereof within the scope of this disclosure, a coaxial cooler having a heat transfer tube, comprises at least in part, one or more straight sections having a plain or smooth surface. The plain surface ensures good coolant flow over the heat exchange surface. Eddies of low coolant flow present in the roots of the corrugations may be eliminated, and boiling may thereby be very significantly reduced. Further, as the heat exchange surfaces may be plain or smooth, the drag caused by those surfaces on passing gas may be much reduced, and so gas pressure drop may be significantly reduced in comparison to a conventional corrugated heat exchange tube.

In general, providing a smooth heat exchange surface reduces turbulence, but also reduces heat exchange. To achieve a relatively high heat exchange per unit length, a plurality of fins are joined to an inner surface of a heat exchange tube. The heat transfer tube may be a plain or smooth surface over its whole length, including any bends in the tube.

Alternatively, the heat exchange tube may have corrugations on the bend portion, or on a section of the straight portion, or on both. The corrugations may be either annular or helical. The corrugated section may have a varying pitch, which improves performance of the heat exchanger, or facilitates improved assembly of the heat exchanger.

Adapter tubes for the coolant inlet and outlet which join the main heat exchanger body may be pressed, cast, machined, sintered or 3-D printed in order to minimise their size. For cost reasons, the adapters may be formed.

These exchangers may operate with the gas flow in contraflow to the liquid coolant, or with the gas flow coincident or parallel with the liquid coolant flow.

An outer tube which is positioned around a central heat exchange tube may be partially corrugated or may be plain and smooth. Where corrugated, the corrugations may be either annular or helical. The corrugated section may comprise a varying pitch along its length, to improve performance, or to improve assembly.

The fin components may be made of austenitic or ferritic stainless steel. Ferritic stainless steel has a high thermal conductivity which may make the fins more effective for heat transfer. For very high temperature applications, an Inconel fin may be used.

The fins may be attached to the inside of the heat exchange tube by a brazing process or by a welding process. The fins may be formed in a rolled strip forming an arc between 0° and 350°. The natural resilience of the strip material when inserted into the inside of a heat exchange tube increases the angle of the arc, pushing the fin out to contact the heat exchange tube surface.

Successive fins may be of the same length or differing lengths. Where fins are all of the same length, then as the fins extend towards the centre of the tube, the gap between the fins may become small, causing increased drag on gases passing in the vicinity of those parts of the fin, leading to low velocities and relatively poor heat exchange. To ensure that the fins are as efficient as possible, the fins may be attached to the heat exchange tube as near to right angles to the inner circular cylindrical surface of the tube as possible. This can be achieved by having a sharp radius of curvature on the fin on the transition from the circumferential part of the fin to the radially extending part of the fin which extends radially into the heat exchange tube. Having a good braze meniscus on the joint between the fin and the heat exchange tube also helps to achieve high heat transfer efficiency between the fin and the tube.

There may be between 1 and 30 individual radially extending fins inside the inner tube. The cooler may optimally have a heat exchange tube inner diameter of between 5 mm and 50 mm in preferred embodiments.

Any of the individual fins structures and fin assemblies disclosed herein may be used with any one of the heat exchanger embodiments disclosed herein in any combination.

Dimples formed outward from the heat exchange tube may be used to improve heat exchange and to centre the heat exchange tube inside the outer tube. The dimples aid concentricity of the inner tube to the outer casing or tube, especially when a cooler has more than one bend.

The invention claimed is:

1. A heat exchanger for cooling hot gas using a coolant, said heat exchanger comprising:

at least one inner heat exchange tube adapted for exchanging heat between a gas flowing within the at least one inner heat exchange tube and a coolant flowing outside the at least one inner heat exchange tube, said at least one inner heat exchange tube having an inner surface and an outer surface;

a tubular outer body surrounding at least part of said inner heat exchange tube, said tubular outer body having an inner surface and an outer surface;

wherein said heat exchanger is configured to enable the gas to flow through said at least one inner heat exchange tube and the coolant to flow between said outer surface of said inner heat exchange tube and said inner surface of said tubular outer body; and a single cylindrically-shaped corrugated sheet of material forming a plurality of fins configured for orientation within said at least one inner heat exchange tube, wherein at least one of the fins is in contact with said inner surface of said at least one inner heat exchange tube, one of said plurality of fins comprising:

an outer fin connector positioned adjacent to the inner surface of said inner heat exchange tube, said outer fin connector having a pair of opposing ends;

a pair of straight fin walls extending radially inwardly from the opposing ends of said outer fin connector, respectively, each of said straight fin walls converging toward the central longitudinal axis of said at least one inner heat exchange tube; and a fin assembly gap positioned within said outer fin connector and formed between a portion of a first end of said cylindrically-shaped corrugated sheet and a portion of a second end of said cylindrically-shaped corrugated sheet.

2. The heat exchanger of claim 1, wherein said portion of the first end of said cylindrically-shaped corrugated sheet includes one or more raised protrusions that at least partially overlap the fin assembly gap in said outer fin connector.

3. The heat exchanger of claim 1, wherein one or more of the plurality of fins includes undulations for increasing turbulence in the gas, each of said undulations oriented along the longitudinal axis of said at least one inner heat exchange tube.

4. The heat exchanger of claim 1, wherein at least one of said plurality of fins includes one or more radially-extending slots.

5. The heat exchanger of claim 4, wherein said one or more radially-extending slots have a non-uniform width as measured along the longitudinal axis of said at least one inner heat exchange tube.

6. The heat exchanger of claim 5, wherein said one or more radially-extending slots includes a straight portion and a circular segment portion collectively forming a bulb-shaped slot.

7. The heat exchanger of claim 6, wherein said bulb-shaped slot has a width of at least 0.2 millimeters over said straight portion of said bulb-shaped slot.

8. The heat exchanger of claim 4, in which at least one of the one or more radially-extending slots extends across two adjacent radially-extending fin walls formed by two adjacent fins at an innermost position closest to the axial center of the at least one inner heat exchange tube.

9. The heat exchanger of claim 4, wherein each said one or more radially-extending slots have a uniform width of at least 0.2 millimeters.

10. A heat exchanger for cooling hot gas using a coolant, said heat exchanger comprising:

at least one inner heat exchange tube adapted for exchanging heat between a gas flowing within the at least one inner heat exchange tube and a coolant flowing outside the at least one inner heat exchange tube, said at least one inner heat exchange tube having an inner surface and an outer surface;

a tubular outer body surrounding at least part of said inner heat exchange tube, said tubular outer body having an inner surface and an outer surface;

wherein said heat exchanger is configured to enable the gas to flow through said at least one inner heat exchange tube and the coolant to flow between said outer surface of said inner heat exchange tube and said inner surface of said tubular outer body; and a cylindrically-shaped corrugated sheet of material forming a plurality of fins configured for orientation within said at least one inner heat exchange tube, wherein at least one of the fins is in contact with said inner surface of said at least one inner heat exchange tube, said at least one of the fins comprising:

an outer fin connector positioned adjacent to the inner surface of said inner heat exchange tube, said outer fin connector having a pair of opposing ends, a pair of straight fin walls extending radially inwardly from the opposing ends of said outer fin connector, respectively, each of said straight fin walls converging toward the axial center of said at least one inner heat exchange tube; and an inner gap between said pair of straight fin walls, said inner gap being located closer to the axial center of said at least one inner heat exchange tube than the outer fin connector, wherein the distance between the pair of straight fin walls at the inner gap is shorter than the distance between the pair of straight fin walls at the outer fin connector, wherein a particular fin of the plurality of fins defines a fin assembly gap formed between a portion of a first end of said cylindrically-shaped corrugated sheet and a portion of a second end of said cylindrically-shaped corrugated sheet, said portion of the first end of said cylindrically-shaped corrugated sheet including one or more raised protrusions that at least partially overlap said portion of the second end of said cylindrically-shaped corrugated sheet.

11. A heat exchanger for cooling hot gas using a coolant, said heat exchanger comprising:

at least one inner heat exchange tube adapted for exchanging heat between a gas flowing within the at least one inner heat exchange tube and a coolant flowing outside the at least one inner heat exchange tube, said at least one inner heat exchange tube having an inner surface and an outer surface, at which outer surface heat exchange occurs;

a tubular outer body surrounding at least part of said inner heat exchange tube, said tubular outer body having an inner surface and an outer surface;

wherein said heat exchanger is configured to enable the gas to flow through said at least one inner heat exchange tube and the coolant to flow between said outer surface of said inner heat exchange tube and said inner surface of said tubular outer body; and a cylindrically-shaped corrugated sheet of material forming a plurality of fins configured for orientation within said at least one inner heat exchange tube, in which at least one of the fins is in contact with said inner surface of said at least one inner heat exchange tube, at least one of said plurality of fins comprising:

an outer fin connector positioned adjacent to the inner surface of said inner heat exchange tube, said outer fin connector having a pair of opposing ends;

a pair of straight fin walls extending radially inwardly from the opposing ends of said outer fin connector, respectively, each of said straight fin walls converging toward the central longitudinal axis of said at least one inner heat exchange tube; and an inner gap oriented between said pair of straight fin walls, said inner gap being located closer to the axial center of said at least one inner heat exchange tube than the outer fin connector, wherein a particular fin of the plurality fins defines a fin assembly gap formed between a portion of a first end of said cylindrically-shaped corrugated sheet and a portion of a second end of said cylindrically-shaped corrugated sheet.

* * * * *